US007368211B2

(12) United States Patent
Hasegawa et al.

(10) Patent No.: US 7,368,211 B2
(45) Date of Patent: May 6, 2008

(54) MAGNETIC TONER

(75) Inventors: Yusuke Hasegawa, Shizuoka-ken (JP); Yoshihiro Ogawa, Numazu (JP); Shinichiro Abe, Toride (JP); Junko Nishiyama, Mishima (JP); Takashige Kasuya, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 498 days.

(21) Appl. No.: 11/168,507

(22) Filed: Jun. 29, 2005

(65) Prior Publication Data

US 2006/0078812 A1 Apr. 13, 2006

(30) Foreign Application Priority Data

Oct. 8, 2004 (JP) ..... 2004-296446

(51) Int. Cl.
*G03G 9/083* (2006.01)

(52) U.S. Cl. ..... 430/106.1; 430/106.2; 430/109.4

(58) Field of Classification Search ..... 430/106.1, 430/106.2, 109.4
See application file for complete search history.

(56) References Cited

U.S. PATENT DOCUMENTS

| | | | | |
|---|---|---|---|---|
| 4,206,064 | A | 6/1980 | Kiuchi et al. | 430/106 |
| 4,404,271 | A | 9/1983 | Kawagishi et al. | 430/110 |
| 5,652,060 | A | 7/1997 | Uchida et al. | 428/404 |
| 5,843,610 | A | 12/1998 | Uchida et al. | 430/106.6 |
| 5,874,019 | A | 2/1999 | Uchida et al. | 252/62.59 |
| 6,013,193 | A | 1/2000 | Hashiuchi et al. | 252/62.59 |
| 6,059,988 | A | 5/2000 | Hashiuchi et al. | 252/62.58 |
| 6,803,164 | B2 | 10/2004 | Mizoo et al. | 430/106.2 |

FOREIGN PATENT DOCUMENTS

| | | |
|---|---|---|
| JP | 41-020153 | 11/1966 |
| JP | 44-006397 | 3/1969 |
| JP | 45-026478 | 9/1970 |
| JP | 50-133838 | 10/1975 |
| JP | 55-042752 | 11/1980 |
| JP | 58-041508 | 9/1983 |
| JP | 59-007385 | 2/1984 |
| JP | 03-002276 | 1/1991 |
| JP | 03-101743 | 4/1991 |
| JP | 03-101744 | 4/1991 |
| JP | 07-239571 | 9/1995 |
| JP | 07-240306 | 9/1995 |
| JP | 07-267646 | 10/1995 |
| JP | 08-034617 | 2/1996 |
| JP | 08-133744 | 5/1996 |
| JP | 08-133745 | 5/1996 |
| JP | 09-059024 | 3/1997 |
| JP | 09-059025 | 3/1997 |
| JP | 10-072218 | 3/1998 |
| JP | 10-171157 | 6/1998 |
| JP | 11-157843 | 6/1999 |
| JP | 11-189420 | 7/1999 |
| JP | 2003-162089 | 6/2003 |
| JP | 2003-192352 | 7/2003 |
| JP | 2003-195560 | 7/2003 |
| JP | 2004-078055 | 3/2004 |
| JP | 2004-4139071 | 5/2004 |

OTHER PUBLICATIONS

Polymer Handbook, 2nd Edition, published by John Wiley & Sons, pp. III-140-III-192 (1971).

*Primary Examiner*—Mark A. Chapman
(74) *Attorney, Agent, or Firm*—Fitzpatrick, Cella, Harper & Scinto

(57) ABSTRACT

To provide a magnetic toner which is excellent in durability and developability even in the case of being applied to high-speed developing process or being used in a large-capacity process cartridge amount of toner in which is increased, and which has high degree of blackness. Provided is a magnetic toner having magnetic toner particles containing at least a binder resin and magnetic material particles each comprising a predetermined amount of a titanium compound, characterized in that:

1) the magnetic material particles have a predetermined amount of adsorbed moisture at a relative vapor pressure of 50%; and 2) a difference between the amount of moisture adsorbed to the magnetic material particles in an adsorbing process for increasing a relative vapor pressure and the amount of moisture adsorbed to the magnetic material particles in a desorbing process for reducing a relative vapor pressure is reduced.

7 Claims, No Drawings

MAGNETIC TONER

BACKGROUND OF THE INVENTION

1. Field of the Invention

The present invention relates to: an electrophotograph; an image forming method for visualizing an electrostatic image; and a magnetic toner for toner jetting.

2. Description of the Related Art

In recent years, an image forming apparatus has been further requested to have a high-speed process and long-term high reliability in addition to high definition, high appearance quality, and high image quality. A reduction of toner particle size and a sharpening of a toner particle size distribution have been attempted to achieve a high-resolution and high-definition development method. However, when the particle size of toner is merely reduced, dispersibility of a internal additive into a binder resin is apt to affect toner performance.

In particular, in the case of magnetic toner having magnetic toner particles used for a one-component development method in which a reduction in size of an image forming apparatus is advantageous, various properties requested for the magnetic toner such as development property and durability may be affected by the state of dispersion of magnetic material particles in the magnetic toner particles.

When magnetic material particles are insufficiently dispersed into magnetic toner particles, the total amount of magnetic material particles exposed to the magnetic toner particle surfaces is different from one another. When the amount of magnetic material particles on the magnetic toner particle surfaces is small, the magnetic toner particle surfaces have high charge amounts when they are subjected to triboelectric charging with a charge imparting member (developing sleeve), so charge-up occurs.

On the other hand, when the amount of magnetic material particles on the magnetic toner particle surface is excessively large, charge is apt to leak, so a high charge amount is hardly obtained. Moreover, a toner of opposite charging polarity is apt to generate owing to contact between any one of the magnetic material particles and a binder resin, so the width of a charge distribution expands. The expansion may be responsible for the deterioration of image quality.

Meanwhile, a contact charging method has been adopted in many cases, which involves charging a photosensitive member by means of a contact charging member without the use of a corona charging device that generates ozone. When magnetic material particles are not uniformly dispersed into magnetic toner particles, magnetic toner the surface of which has an excessive amount of magnetic material particles receives mechanical pressure or electrical compression at an abutting portion of the contact charging device and the surface of the photosensitive member, so the surfaces of both members are strongly rubbed with the toner. As a result, a flaw on the photosensitive member is apt to develop, and the flaw may be responsible for an image defect. In contrast, when both the contact charging member and the photosensitive member are strongly rubbed with magnetic toner the surface of which has a small amount of magnetic material particles and has an apparently increased viscoelasticity, the toner is apt to fuse to the photosensitive member. As a result, a contamination of the photosensitive member such as filming is apt to occur.

In general, an external additive is added to magnetic toner particles for improving the fluidity of magnetic toner. However, when the magnetic toner having the external additive deteriorates owing to repetition of a printing step over a long period of time, the external additive is embedded into the magnetic toner particles, so influences of magnetic material particles exposed to magnetic toner particles surfaces become great. As a result, such problems as described above are apt to be remarkable.

In addition, the expansion of the width of a charge distribution due to insufficient dispersion of magnetic material particles as described above is apt to cause so-called selective development in which toner having a certain range of charge amount distribution is selectively consumed. Moreover, the progress of the selective development is apt to further accelerate various problems.

For example, the charging property of magnetic toner becomes susceptible to the environment. In addition, the fluidity of the magnetic toner is reduced, so the toner is insufficiently supplied to a developing sleeve, and charge unevenness of a toner layer on the developing sleeve is caused. Accordingly, "fogging" in which a non-image portion is developed with the toner is apt to occur. In a high-temperature-and-high-humidity environment, a phenomenon called "fading" in which an image density is reduced in a belt fashion tend to occur.

Furthermore, when a toner is transferred from a photosensitive member onto a transfer material, if the toner is excessively charged, a phenomenon called "scattering" is caused, in which the toner is scattered around a letter image or a line image. If a toner has been insufficiently charged for the purpose of suppressing the scattering, the reduction of developability and the fogging may be caused. Additional sharpening of the toner particle size distribution has been attempted to suppress the fogging. However, the sharpening may be a factor for increasing toner production cost due to, for example, a reduction in yield.

In particular, in order to cope with recent trends such as an increasing process speed and an extending lifetime, a high-speed developing system has been employed or a large-capacity process cartridge amount of toner in which is increased has been used. However, these coping with the recent trends tend to make the above problems more remarkable, so quick alleviation of such state has been desired.

JP 03-101743 A and JP 03-101744 A each disclose that the particle sizes of magnetic material particles are reduced and a particle size distribution is narrowed for uniformly dispersing the magnetic material particles into magnetic toner particles. Those measures surely tend to uniformize the dispersion of the magnetic material particles into the magnetic toner particles. However, when the particle size of magnetic toner is reduced for achieving high image quality, the fogging is accelerated. Therefore, the dispersibility of magnetic material particles into magnetic toner particles is still susceptible to improvement.

There also arises a problem of declining degree of blackness in the case that the particle sizes of magnetic material particles are reduced. It has been conventionally known that the degree of blackness of magnetic material particles depends on the content of FeO (or $Fe^{2+}$). However, the FeO (or $Fe^{2+}$) content in the magnetic material particles reduces as deterioration with time due to oxidation proceeds, with the result that the degree of blackness of the magnetic material particles reduces. It is needless to say that the deterioration with time largely depends on the environment where the magnetic material particles are placed. The deterioration is also accelerated by the reduction of particle sizes of the magnetic material particles.

Magnetic material particles with reduced particle sizes are susceptible to heat as well as time. In order to uniformly disperse magnetic material particles into magnetic toner particles in the production step of magnetic toner, it is preferable that a melting and kneading temperature is set at a high temperature and a binder resin is kneaded after it has been melted to be soft. In particular, when a binder resin containing a hard component such as THF insoluble matter is used, the binder resin is preferably softened and kneaded at a high temperature in order to uniformly disperse magnetic material particles into the binder resin. Even magnetic material particles having high degree of blackness can be oxidized depending on the particle sizes of the magnetic material particles and on the melting and kneading temperature in the toner production process, with the result that toner that looks reddish may be finally obtained.

In general, a polyester resin is preferably used as a binder resin than a styrene-based resin from the view of obtaining toner excellent in low-temperature fixability. However, the polyester resin has a large number of acidic functional groups in its molecular structure, so magnetic material particles in the polyester resin are placed in an acidic environment in the kneading process. Accordingly, the oxidization of magnetic material particles in the polyester resin tends to proceed in particular.

To solve those problems, a large number of proposals have been conventionally made, in each of which various elements are added to magnetic material particles in magnetic toner particles.

JP 08-133744 A and JP 08-133745 A each disclose a magnetic material particle coated with a coating layer containing an element selected from the group consisting of Si, Al, and Ti.

However, these magnetic material particles may cause defects concerning development. For example, these magnetic material particles for uniformly being dispersed into magnetic toner particles are insufficient for the prevention of a reduction of blackness and an improvement of heat resistance. Furthermore, the magnetic material particles can be oxidized when kneaded at a high temperature. And the magnetic properties of the magnetic material particles can be affected by some of the elements to be added. In particular, when the magnetic material particles are used in combination with a resin having a relatively high acid value, the added elements are apt to be eluted from the magnetic material particles.

Magnetic material particles have also been known, each of which contains 1.7 to 4.5 atom % of Si based on Fe atom, and 0 to 10 atom % of one or two or more metal elements selected from the group consisting of Mn, Zn, Ni, Cu, Al, and Ti based on Fe atom (see, for example, JP 09-59024 A1 and JP 09-59025 A1). The magnetic material particles can improve the magnetic properties and charging property of magnetic toner. However, when the above metals are merely added to the magnetic material particles, compatibility between a developability of the magnetic toner and an image quality and the like in a high-speed developing system are still susceptible to improvement.

Such magnetic material particles as described below have also been known (see, for example, JP 11-157843 A). Each of the magnetic material particles includes Si component in its particle center to particle surface continuously. And a part of the Si component is exposed to the magnetic material particle surface. In addition, the outer shell of each of the magnetic material particles is coated with a metal compound comprising at least one metal component selected from the group consisting of Zn, Mn, Cu, Ni, Co, Cr, Cd, Al, Sn, Mg, and Ti. The metal compound is bound to the Si component. The use of such magnetic material particles shows good developability at an initial stage of printing duration, however could not alleviate a reduction of image quality or developability such as the acceleration of fogging due to long-term use, particularly in a high-speed developing system. Therefore the magnetic material particles are still susceptible to improvement.

Such magnetic material particles as described below have also been known (see, for example, JP 11-189420 A). Each of the magnetic material particles contains Si component and Al component. Those components are presented in its center to its surface continuously, and a part pf those components are exposed to the particle surface. In addition, the outer shell of each of the particles is coated with a metal compound comprising at least one metal component selected from the group consisting of Zn, Mn, Cu, Ni, Co, Cr, Cd, Al, Sn, Mg, and Ti. The metal compound is bound to the Si component and the Al component. However, the use of such magnetic material particles could not imparted sufficient charging stability to magnetic toner yet.

JP 07-239571 A discloses a magnetic material particle having on its surface an oxide containing an element selected from the group consisting of iron, aluminum, titanium, zirconium, and silicon. JP 07-267646 A discloses a magnetic material particle having an element selected from the group consisting of Zn, Mn, Cu, Ni, Co, Mg, Cd, Al, Cr, V, Mo, Ti, and Sn. JP 10-72218 A discloses a magnetic material particle having on its surface an element selected from the group consisting of Si, Al, Ti, Zr, Mn, Mg, and Zn.

JP 07-240306 A discloses such a spherical magnetic material particle described below. The particle contains 0.10 to 1.00 mass % of a silicon element in it. A coprecipitate of silica and alumina is present on the surface of the particle. Furthermore, at least one kind of fine particle powder of non-magnetic oxide or non-magnetic water-containing oxide of element selected from the group consisting of Fe, Ti, Zr, Si, and Al is fixed in an amount of 0.1 to 10 wt % to the coprecipitate. JP 10-171157 A discloses a hexahedral magnetic material particle containing 0.9 atom % or more and less than 1.7 atom % of Si based on Fe atom and having on its particle surface an adherend layer composed of an oxide, hydroxide, water-containing oxide, or a mixture thereof of one or two or more kinds of elements selected from the group consisting of Mn, Zn, Ti, Zr, Si, and Al.

JP 2003-195560 A and JP 2004-139071 A disclose a toner containing a magnetic material particle having an isoelectric point of 5 to 6.5 and a magnetic material particle having an isoelectric point of 5 to 9, respectively.

Furthermore, JP 2004-78055 A discloses a toner with its amount of adsorbed moisture and average circularity specified.

In each of JP 08-34617 A, JP 03-2276 A, JP 2003-192352 A1, and JP 2003-162089 A1, a titanium compound is allowed to be in a magnetic material particle or on the surface thereof.

A good developability may be achieved by each of the above inventions. However, when each of them is applied to a high-speed developing system having a high process speed and employing a large-capacity cartridge, additional improvements of developability and durability are desired in many cases. Furthermore, when the amount of an added element is excessively large or the smoothness of the surface of a magnetic material particle is not good, the amount of moisture adsorbed to the magnetic material particles becomes excessively large. As a result, various problems arise from the fluidity or chargeability of magnetic toner such as a flaw or filming on a photosensitive member, fogging or fading of image, or scattering of the toner. In addition, resistance to oxidation and stability of the magnetic material particles are still susceptible to improvement, in the case that the magnetic material particles is mixed with a resin having a relatively high acid value such as a polyester resin in the production process of toner particles.

In addition, depending on the kind and amount of added element, the amount of moisture adsorbed to a magnetic material particle becomes excessively large or the adsorbed moisture is hardly desorbed. As a result, problems are apt to occur such as a significant reduction in chargeability of the toner after standing particularly in a high-temperature-and-high-humidity environment.

As described above, the realization of magnetic toner which is excellent in durability and developability even when it is applied to a high-speed developing system having a high process speed and employing a large-capacity cartridge, and which has high degree of blackness requires further investigation.

SUMMARY OF THE INVENTION

Therefore, an object of the present invention is to provide a magnetic toner that has solved the problems described above.

That is, an object of the present invention is to provide a magnetic toner which is excellent in durability and developability and has high degree of blackness, even when the magnetic toner is applied to high-speed developing process or used in a large-capacity process cartridge amount of toner in which is increased.

The inventors of the present invention have made extensive studies to find the following. That is, a magnetic toner having magnetic toner particles containing a binder resin and magnetic material particles each containing a titanium compound, in which: I) a ratio A [mass %] of a mass of moisture adsorbed to the magnetic material particles to a total mass of the magnetic material particles at a temperature of 28° C. and at a relative vapor pressure of 50% is 0.25 to 0.80 [mass %]; II) a difference at an arbitrary relative vapor pressure between a mass of moisture adsorbed to the magnetic material particles in an adsorbing process for increasing a relative vapor pressure at a constant temperature and a mass of moisture adsorbed to the magnetic material particles in a desorbing process for reducing a relative vapor pressure at the same temperature is 0.10 mass % or less based on the total mass of the magnetic material particles; and III) a ratio B [mass %] of a mass of the titanium compound in $TiO_2$ equivalent to the total mass of the magnetic material particles is 0.1 to 10.0 [mass %], can achieve the object of the present invention. Thus, the inventors have completed the present invention.

According to the magnetic toner of the present invention, toner scattering around a letter image or the acceleration of fogging in the latter half of printing duration can be suppressed, even when the magnetic toner is applied to high-speed developing process or used in a large-capacity process cartridge amount of toner in which is increased.

According to the magnetic toner of the present invention, the occurrence of a flaw or filming on a photosensitive member can also be suppressed, even when a process speed is increased or when a contact charging method is adopted.

Furthermore, by using magnetic material particles in the present invention, even when a kneading step in the production process of magnetic toner is performed at a high temperature, magnetic toner having excellent blackness can be obtained.

DESCRIPTION OF THE PREFERRED EMBODIMENTS

A magnetic toner of the present invention contains at least a binder resin and magnetic material particles.

The inventors of the present invention have found that the object of the present invention can be achieved by using magnetic material particles exhibiting specific moisture adsorption/desorption behavior.

The magnetic material particles exhibiting specific moisture adsorption/desorption behavior specifically include magnetic material particles satisfying the following two points.

(1) A ratio of the mass of moisture adsorbed to the magnetic material particles to the total mass of the magnetic material particles at a temperature of 28° C. and at a relative vapor pressure of 50% is 0.25 to 0.80 mass %.

(2) A difference at an arbitrary relative vapor pressure between the mass of moisture adsorbed to the magnetic material particles in an adsorbing process for increasing a relative vapor pressure at a constant temperature and the mass of moisture adsorbed to the magnetic material particles in a desorbing process for reducing a relative vapor pressure at the same temperature is 0.10 mass % or less based on the total mass of the magnetic material particles. Here, the "constant temperature" is preferably 28° C., and the "arbitrary relative vapor pressure" is preferably in the range of 5% to 90%. That is, the maximum difference in mass at a relative vapor pressure of 5 to 90% is preferably 0.10 mass % or less based on the total mass of the magnetic material particles.

As the difference between "the mass of moisture adsorbed to the magnetic material particles in an adsorbing process" and "the mass of moisture adsorbed to the magnetic material particles in a desorbing process" increases, the surface of each of the magnetic material particles has property or a structure with which water once adsorbed is hardly desorbed.

That is, when (1) a ratio of the mass of moisture adsorbed to the magnetic material particles to the total mass of the magnetic material particles at a relative vapor pressure of 50% is 0.25 to 0.80 mass %, and (2) a ratio of a difference between "the mass of moisture adsorbed to the magnetic material particles in an adsorbing process" and "the mass of moisture adsorbed to the magnetic material particles in a desorbing process" to the total mass of the magnetic material particles is 0.10 mass % or less, the surface of each of the magnetic material particles can retain an appropriate amount of moisture having a high degree of freedom of adsorption/desorption.

A magnetic toner containing magnetic material particles satisfying the above conditions (1) and (2) has extremely good environmental stability. That is, a reduction in chargeability is small and selective development can be suppressed, even when the magnetic toner is applied to high-speed developing process or used in a a large-capacity process cartridge amount of toner in which is increased.

A magnetic toner containing magnetic material particles having a ratio of the mass of moisture adsorbed to the magnetic material particles to the total mass of the magnetic material particles at a relative vapor pressure of 50% (which may hereinafter be referred to as a ratio A) of less than 0.25 mass % is apt to cause fogging or toner scattering after long-term printing duration particularly in a low-humidity environment, thereby the deterioration of image quality can be raised.

A magnetic toner containing a) magnetic material particles having a ratio A in excess of 0.80 mass % or b) magnetic material particles having a ratio of a difference between "the mass of moisture adsorbed to the magnetic material particles in an adsorbing process" and "the mass of moisture adsorbed to the magnetic material particles in a desorbing process" to the total mass of the magnetic material particles (which may hereinafter be referred to as a ratio ΔA) in excess of 0.10 mass %, the magnetic material particles having a ratio A of 0.25 mass % to 0.80 mass %, involves such problems as described below. For example, the charging property of the magnetic toner is apt to be deteriorated particularly in high humidity. In addition, the rise-up of charging of the magnetic toner is slow. Furthermore, the color density of the magnetic toner is low at an initial stage of printing duration.

The mass of moisture adsorbed to the magnetic material particles at a relative vapor pressure of 50% can be controlled by adjusting, for example, the average particle size of the magnetic material particles and the content of the titanium compound in the magnetic material particles.

In addition, the difference between "the mass of moisture adsorbed to the magnetic material particles in an adsorbing process" and "the mass of moisture adsorbed to the magnetic material particles in a desorbing process" can be controlled by adjusting, for example, the content of the titanium compound in the magnetic material particles and the pH of an aqueous suspension of the magnetic material particles for adding the titanium compound to the magnetic material particles.

The mass of moisture adsorbed to the magnetic material particles in the present invention can be measured by means of a device that can lead to solid-gas equilibrium in atmosphere where only the gas of interest (water vapor in the present invention) is present and can measure a solid mass and a vapor pressure under the equilibrium condition. An example of such apparatus include an adsorption equilibrium measuring device (EAM-02; manufactured by JT Toshi Inc.). In examples to be described below, the mass of moisture adsorbed to magnetic material particles was measured by means of the device EAM-02.

The mass of moisture adsorbed to the magnetic material particles of the present invention can be determined from adsorption/desorption isotherms. The adsorption/desorption isotherms can be obtained by automatically performing all of a) measurement of the mass of dry matter, b) deaeration of air dissolved in water, c) measurement of an adsorption equilibrium pressure, d) measurement of an amount of adsorption at each relative vapor pressure, and the like. The outline of measurement, which is described in the operation manual published by JT Toshi Inc., is as follows.

About 5 g of toner are loaded into a sample container in an adsorption tube in the device. The temperature of a thermostat and the temperature of a sample portion are set to 28° C. Then, V1 (main valve) and V2 (exhaust valve) are opened to actuate a vacuum exhaust unit, thereby evacuating the inside of the sample container to a pressure of about 0.01 mmHg. Thus, the sample is dried. The mass at the time when the weight of the sample does not change is defined as "the mass of dry matter".

Since air can be dissolved into a solvent (water in the present invention), the solvent should be subjected to degassing treatment. First, the solvent (hereinafter, referred to as water) is charged into a reservoir of the device, and the V1 and the V3 are closed. Then, the vacuum exhaust unit is actuated in a state where the V2 is opened. After that, the V2 is closed and the V3 is opened to introduce air into the path between the V2 and the V3. Furthermore, the V3 is closed and then the V2 is opened for degassing from the water, followed by closing of the V2. Such operation of alternately opening and closing the V2 and the V3 as described above is repeated several times. Observing no bubbles in the water in the reservoir is defined as the completion of the degassing treatment.

Subsequent to the measurement of the mass of dry matter and the degassing treatment of water, the V1 (main valve) and the V2 (exhaust valve) are closed and the V3 (reservoir valve) is opened while the pressure inside the sample container is kept at a vacuum. Thus, water vapor is introduced from the reservoir to the path from the V1 to the V3, and then the V3 (reservoir valve) is closed.

Next, the V1 (main valve) is opened to introduce water vapor into the sample container, and a pressure inside the container at this step is measured by means of a pressure sensor. If the measured pressure inside the sample container does not reach the predetermined pressure, the above operation is repeated to increase the pressure inside the sample container to the predetermined pressure. The equilibrium is realized when the pressure inside the sample container and the mass of the sample become constant. The pressure and the temperature inside the sample container and the mass of the sample under the equilibrium are determined as equilibrium data.

Furthermore, adsorption/desorption isotherms can be obtained by coordinating the pressure of water vapor. In actual measurement, a relative vapor pressure at which the mass of adsorbed moisture is measured is predetermined. When the predetermined pressure is set to, for example, 5%, 30%, 60%, 80%, or 90%, the term "adsorbing process" refers to a process of creating an isotherm (adsorption isotherm) by: increasing the relative vapor pressure from 5% to 90%; and measuring the mass of adsorbed moisture at each predetermined pressure. In contrast, the term "desorbing process", which is performed subsequent to the adsorbing process, refers to a process of creating an isotherm (desorption isotherm) by: decreasing the relative vapor pressure from 90% to 5%; and measuring the mass of adsorbed moisture at each predetermined pressure.

The adsorption/desorption isotherms of typical magnetic toner may show "hysteresis loop", in which the "desorption isotherm" of the desorbing process shifts to higher mass of adsorbed moisture than the "adsorption isotherm" of the adsorbing process.

The magnetic toner of the present invention is characterized in that a difference between the "adsorption isotherm" and the "desorption isotherm" in the adsorption/desorption isotherms is small. To be specific, the magnetic toner is characterized in that a difference at an arbitrary relative vapor pressure between the mass of adsorbed moisture indicated by the "adsorption isotherm" and the mass of adsorbed moisture indicated by the "desorption isotherm" is 0.10 mass % or less based on the total mass of magnetic material particles. Here, the arbitrary relative vapor pressure is preferably in the range of 5% to 90%. That is, the maximum difference in mass at a relative vapor pressure of 5% to 90% is preferably 0.10 mass % or less based on the total mass of the magnetic material particles.

This device could set a pressure in relative vapor pressure (%) unit, and represent adsorption/desorption isotherms of an amount of adsorbed moisture (%) and the relative vapor pressure (%). The equations for calculating the adsorption and the relative vapor pressure are shown below.

$$M=(Wk-Wc)/Wc\times 100 \quad (11)$$

$$Pk=Q/Q0\times 100 \quad (12)$$

In the equation (11), M represents the amount of adsorbed moisture (%), Wk (mg) represents the mass of a sample, and Wc (mg) represents the mass of the dry matter of the sample.

In the equation (12), Pk represents the relative vapor pressure (%), Q0 (mmHg) represents the saturated vapor pressure determined by means of Antoine's equation from a temperature Tk (° C.) at adsorption/desorption equilibrium, and Q (mmHg) represents the pressure (equilibrium vapor pressure) measured as equilibrium data.

The isoelectric point of the magnetic material particles in the present invention is in the range of preferably pH 4.1 to 8.0, or more preferably pH 4.5 to 6.5. The isoelectric point of the magnetic material particles in the present invention refers to a hydrogen ion concentration in aqueous solution into which the magnetic material particles are dispersed and a zeta potential of which is 0.

The adsorption/desorption behavior of moisture adsorbed to the surfaces of magnetic material particles having the isoelectric point of less than pH 4.1 may not be appropriately controlled for achieving the object of the present invention.

The adsorption/desorption behavior of moisture adsorbed to magnetic material particles having the isoelectric point in excess of pH 8.0 may not be appropriately controlled for achieving the object of the present invention. Moreover, a dispersibility of the magnetic material particles into magnetic toner particle is deteriorated owing to reducing of fluidity, or heat resistance of the magnetic material particles is reduced in some cases. In addition, when a magnetic toner containing the magnetic material particles is applied to a high-speed developing process or a process adopting the contact charging method, a flaw or filming on a photosensitive member is apt to occur.

The isoelectric point of magnetic material particles can be adjusted by controlling, for example, 1) the kind of a magnetic material, 2) the kind and loading of a non-magnetic material to be incorporated into the magnetic material particles, and 3) the kind and amount of a coating material with which the magnetic material particles are to be coated, and the coating state thereof.

The isoelectric point of magnetic material particles can be measured as follows.

First, the magnetic material particles are dissolved or dispersed into ion-exchanged water at 25° C. to adjust a sample concentration to 1.8 vol %. Titration is performed with 1N HCl to measure a zeta potential by means of an ultrasonic zeta potential measuring device DT-1200 (manufactured by Dispersion Technology). A pH of the solution, the zeta potential of which is 0 mV, is determined as the isoelectric point.

Furthermore, the magnetic material particles in the present invention preferably contain a titanium compound, and the content of the titanium compound in $TiO_2$ equivalent is preferably 0.1 mass % to 10.0 mass %, or more preferably 0.5 mass % to 9.0 mass % based on the total mass of the magnetic material particles.

The inventors of the present invention have made extensive studies to find that magnetic material particles, which a) contain a titanium compound in the above range, b) have moisture adsorbed to the surfaces thereof to exhibit such adsorption/desorption behavior as described above, and c) have an isoelectric point in the above range, let the titanium compound to be preferentially present on the surfaces of the magnetic material particles. The inventors have also found that such magnetic material particles may fully exert an effect of interest of the present invention.

That is, on the surface of the magnetic material particles, a titanium compound is preferentially present and component(S) of the magnetic material particles except the titanium compound (such as iron oxide which is hard component) are difficult to be present. Therefore, in the case where a repetition of developing process employing a contact charging method is performed over a long period of time, the direct contact between the component(S) (except the titanium compound) of the magnetic material particles exposed to the surface of the magnetic toner and a photosensitive member can be restrained. As a result, the photosensitive member is hardly damaged.

In addition, the magnetic material particles containing a titanium compound have good fluidity and have low aggregability. Therefore, a dispersibility of the magnetic material particles into toner particles is good. As a result, an appropriate amount of the magnetic material particles exposed to the surface of magnetic toner can suppress the occurrence of: toner-filming on a photosensitive member; or fading in a high-humidity environment.

Furthermore, the preferential presence of the titanium compound near the surface of the magnetic material particles can improve heat resistance and oxidation resistance without impairing the intrinsic magnetic properties and chargeability of the magnetic material particles. Therefore, such magnetic material particles are hardly oxidized through a melting and kneading step, a temperature in which is high, in the production process of toner particles. Furthermore, a resin having a relatively high acid value can be used as a toner resin, therefore the magnetic toner having high degree of blackness can be obtained by utilizing the properties of the toner resin.

It is difficult to appropriately control 1) the adsorption/desorption behavior of moisture on the surfaces and 2) the isoelectric point, of magnetic material particles having a ratio of the mass of the titanium compound in the magnetic material particles in $TiO_2$ equivalent to the total mass of the magnetic material particles (which may hereinafter be referred to as "a ratio B") of less than 0.1 mass %. Therefore, a magnetic toner containing such magnetic material particles is apt to cause fogging or filming. Furthermore, such magnetic material particles often have low heat resistance, so the magnetic toner containing them may have reduced degree of blackness.

In magnetic material particles having a ratio B in excess of 10.0 mass %, the adsorption/desorption behavior of moisture on the surfaces of the particles is hardly controlled, and magnetic properties may be deteriorated. Therefore, magnetic toner containing them is apt to have a detrimental effect on image quality such as fogging.

The content of the titanium compound in the magnetic material particles in the present invention can be measured by fluorescent X-ray analysis in accordance with JIS K0119 "General rules for X-ray fluorescence spectrometric analysis". An example of a measuring device includes a fluorescent X-ray analyser SYSTEM 3080 (manufactured by Rigaku Corporation).

In addition, the magnetic material particles in the present invention preferably have an average particle size of 0.08 to 0.25 μm in the view of dispersibility, degree of blackness, magnetic properties, and the like. Magnetic material particles having an average particle size of less than 0.08 μm are not preferable because they may be insufficiently dispersed into magnetic toner particle owing to reaggregation or may have reduced degree of blackness.

Magnetic material particles having an average particle size in excess of 0.25 μm are not preferable because they may not be sufficiently dispersed into toner particles, although they have high degree of blackness.

The average particle size of magnetic material particles can be determined by: randomly selecting 100 particles from magnetic material particles observed on a transmission electron microscope photograph (at a magnification of 30,000); measuring the particle sizes of the selected particles; and averaging the measured particle sizes. The average particle size of the magnetic material particles can be adjusted by, for example, controlling an initial alkali concentration of a solution for an oxidation reaction in magnetic material particle production.

The magnetic material particles in the present invention preferably have magnetic properties in a magnetic field of 795.8 kA/m including: a saturation magnetization of 10 to 200 $Am^2/kg$ (more preferably 70 to 100 $Am^2/kg$); a residual magnetization of 1 to 100 $Am^2/kg$ (more preferably 2 to 20 $Am^2/kg$); and a coercive force of 1 to 30 kA/m (more preferably 2 to 15 kA/m). Magnetic toner containing magnetic material particles having such magnetic properties may have good developability in which an image density and fogging are appropriately balanced.

The magnetic properties of magnetic material particles can be measured in an external magnetic field of 795.8 kA/m by means of, for example, an "oscillation sample type magnetometer VSM-3S-15" (manufactured by Toei Industry Co., Ltd.). The magnetic properties of the magnetic material particles can be adjusted by, for example, the kind and average particle size of the magnetic material particles, and the kind and loading of a non-magnetic material to be incorporated into the magnetic material particles.

Examples of a component of the magnetic material particles in the present invention except a titanium compound include magnetic iron oxides (such as magnetite, maghemite, ferrite, and a mixture thereof) containing heterologous element(s). The component except the titanium compound is preferably mainly composed of magnetite containing a high content of FeO. Magnetite particles can be generally obtained by oxidizing ferrous hydroxide slurry prepared by neutralization an aqueous solution of ferrous salt with an alkali solution.

The magnetic material particles in the present invention are preferably composed of core magnetic material particles and a compound adhering to the surfaces of the core magnetic material particles.

The core magnetic material particles serving as core of the magnetic material particles in the present invention preferably contain Si element. The Si element is preferably present both inside of the core magnetic material particles and on surfaces thereof, and is more preferably preferentially present on the surfaces. In the production process of the core magnetic material particles, the addition of the Si element in a stepwise manner allows the Si element to be preferentially present on the surfaces.

The presence of the Si element on the surfaces of the core magnetic material particles results in the formation of a large number of pores on the surfaces of the core magnetic material particles. Therefore, coating the outer shell of each of such core magnetic material particles with a titanium compound allows the titanium compound to strongly adhere to the surface of the core particle.

The content of the Si element is preferably 0.1 mass % to 1.5 mass %, or more preferably 0.2 mass % to 1.0 mass % based on Fe element. The content of less than 0.1 mass % may result in insufficient adhesive force of the titanium compound to the surfaces of the core magnetic material particles. In contrast, the content in excess of 1.5mass % is apt to result in loss of the smoothness of the surfaces of the core magnetic material particles.

The magnetic material particles of the present invention can be obtained by: obtaining core magnetic material particles by means of a general method of producing magnetite particles; and adding a titanium compound to the core particles to adjust a mass of adsorbed moisture and an isoelectric point to specific ones that may achieve the object of the present invention.

The core magnetic material particles can be produced by means of a conventionally known method of producing magnetic material particles. However, the core magnetic material particles, the surfaces of which preferentially have Si element, can be produced by means of, for example, the following method.

An aqueous solution of ferrous salt and an aqueous solution of 0.90 to 0.99 equivalent of alkali hydroxide based on $Fe^{2+}$ in the aqueous solution of ferrous salt are mixed to prepare a reacted aqueous solution containing a ferrous hydroxide colloid.

Here, 50 to 99% of 0.1 to 1.5 mass % of water-soluble silicate (total content) in an Si element equivalent based on an Fe element is added to the aqueous solution of alkali hydroxide or the reacted aqueous solution containing a ferrous hydroxide colloid.

While the reacted aqueous solution containing the water-soluble silicate is heated in the temperature range of 85 to 100° C., oxygen-containing gas is supplied into the reacted aqueous solution to initiate an oxidation reaction, thereby obtaining the suspension comprising precursors of the core magnetic material particles containing an Si element. The oxidation reaction is preferably performed at a pH of 6.0 to 7.0.

1.00 equivalent or more of alkali hydroxide dissolved in an aqueous solution based on $Fe^{2+}$ remaining in the suspension obtained through the oxidation reaction, and the residue of the water-soluble silicate [1 to 50% of the total content (0.1 to 1.5 mass %)] are added to the suspension. And then, the whole is subjected to an oxidation reaction while being heated in the temperature range of 85 to 100° C. At this time, the oxidation reaction is preferably performed at a pH of 8.0 to 10.5.

Next, the resultant solution is filtered, and the particles obtained are washed, dried, and shredded according to a conventionally known method to produce the core magnetic material particles. Furthermore, the core magnetic material particles are preferably compressed or sheared by means of a mix maller or an automated mortar, or squeezed with a spatula, or the like in order to adjust a smoothness and a specific areas of surface of the core magnetic material particles to fall within preferable ranges.

Examples of the water-soluble silicate used for producing the core magnetic material particles include: silicates such as commercially available soda silicate; and silicic acid such as sol-like silicic acid produced through hydrolysis or the like.

Examples of the ferrous salt used for producing the core magnetic material particles generally include: iron sulfate as a by-product in the production of titanium oxide according to a sulfuric acid method; iron sulfate as a by-product in the surface washing of a steel plate; and iron chloride.

Employing the production method described above, magnetic material particles can be obtained, which are mainly composed of spherical particles each formed of a curved surface having no plate-like surface, and which are nearly free from octahedral particles. The magnetic material particles in the magnetic toner of the present invention preferably have such particle shapes. The shapes of the magnetic material particles can be observed with a transmission electron microscope (H-7500; manufactured by Hitachi, Ltd.).

On the other hand, the core magnetic material particles to be used in the present invention preferably have a small total content (for example, 1 mass % or less) of Al, P, S, Cr, Mn, Co, Ni, Cu, Zn, and Mg. The above components are often present as inevitable components derived from raw materials for production of the magnetic material particles. The reduced total content of the above components in the core magnetic material particles has an increasing effect on the maintenance of a degree of blackness and magnetic properties of the magnetic toner.

As described above, the magnetic material particles in the present invention contain a titanium compound. Titanium may be taken in an iron oxide crystal lattice, or may be taken as a titanium oxide in iron oxide. Preferably, the titanium is present as a titanium oxide or titanium hydroxide on the surfaces of the magnetic material particles.

In particular, coating the core magnetic material particles with $TiO_2$ according to the method described below allows an effect of interest of the present invention to be fully exerted.

An aqueous suspension containing the core magnetic material particles at a concentration of 50 to 200 g/l is held at 60 to 80° C. An aqueous solution of sodium hydroxide or dilute sulfuric acid is added to the aqueous suspension to adjust the pH to 4.0 to 6.0. An amount equivalent to 0.1 to 10.0 mass % of titanium sulfate (in terms of $TiO_2/Fe_3O_4$) dissolved in titanium sulfate aqueous solution, having a concentration of 50 to 150 g/l in $TiO_2$ equivalent, is added to the aqueous suspension over about 1 hour while the aqueous suspension is stirred. During the addition, an aqueous solution of sodium hydroxide is added in such a manner that the pH of the aqueous suspension is held at 4.0 to 6.0. After the completion of the addition, an aqueous solution of sodium hydroxide is added to neutralize the aqueous suspension. The resultant is filtered, and the particles obtained is washed, dried and shredded to produce magnetic material particles coated with titanium oxide.

The content of magnetic material particles in the magnetic toner of the present invention is preferably 50 to 150 parts by mass, or more preferably 60 to 120 parts by mass based on 100 parts by mass of the binder resin of the magnetic toner. The content of less than 50 parts by mass is not preferable because fogging and toner scattering are accelerated, and the magnetic toner may have insufficient coloring power. The content in excess of 150 parts by mass is not preferable because the magnetic toner on a charge imparting member (developing sleeve) cannot sufficiently transfer to a photosensitive member in development process, which may be responsible for a reduction of image density.

The magnetic material particles in the present invention preferably have the following physical properties.

That is, the ratio A (mass %) of the mass of moisture adsorbed to the magnetic material particles to the total mass of the magnetic material particles at a relative vapor pressure of 50% and the ratio B (mass %) of the mass of a titanium compound in the magnetic material particles in $TiO_2$ equivalent to the total mass of the magnetic material particles preferably satisfy the following relationship. As described above, the ratio A (mass %) is 0.25 to 0.80 (mass %), and the ratio B is 0.1 to 10.00 (mass %).

$$0.50 \geqq A/B \geqq 0.05 \quad (1)$$

Magnetic material particles having A/B, which is the ratio of "the ratio A of the mass of adsorbed moisture to the total mass of the magnetic material particles" to "the ratio B of the mass of a titanium compound to the total mass of the magnetic material particles", controlled to 0.05 to 0.50 have surfaces smoothly and densely coated with the titanium compound. As a result, the characteristics of the magnetic material particles in the present invention such as heat resistance and dispersibility into toner particles can be fully exerted with no damages to the magnetic properties and chargeability of the magnetic material particles.

When the ratio A/B is larger than 0.50 and the content of the titanium compound is large, the smoothness of the surfaces of the magnetic material particles coated with the titanium compound is reduced. The reduction of the smoothness may be responsible for an excessive increase in amount of adsorbed moisture or a reduction in fluidity of the magnetic material particles. When the ratio A/B is larger than 0.50 and the content of the titanium compound is small, the area of a surface portion not coated with the titanium compound is increased. Therefore, magnetic toner containing them is apt to cause a flaw or filming on a photosensitive member, and may be poor particularly in heat resistance.

On the other hand, when the ratio A/B is smaller than 0.05, the magnetic material particles have an insufficient amount of adsorbed moisture relative to the content of the titanium compound. As a result, magnetic toner containing them is apt to cause fogging in a low-humidity environment.

The $Fe^{2+}$ content in the magnetic material particles in the present invention is preferably 17 mass % or more based on the total mass of the magnetic material particles in the view of obtaining magnetic material particles having sufficient degree of blackness and good magnetic properties.

Furthermore, an $Fe^{2+}$ content in magnetic material particles after a heat treatment is preferably 60% or more, or more preferably 70% or more based on an $Fe^{2+}$ content in the magnetic material particles before the heat treatment. Hereinafter, a ratio of "an $Fe^{2+}$ content in magnetic material particles after a heat treatment" to "an $Fe^{2+}$ content in the magnetic material particles before the heat treatment" maybe referred to as an "$Fe^{2+}$ retention". The above heat treatment is a heat treatment at 160° C. for 1 hour in air.

Magnetic material particles having an "$Fe^{2+}$ retention" of 60% or more are preferable in the view of finally obtaining magnetic toner having high degree of blackness, because they are excellent in heat resistance and hence are hardly oxidized through a melting and kneading step in toner production process.

The $Fe^{2+}$ content in magnetic material particles can be measured, for example, as follow. Samples (magnetic material particles) are dissolved into sulfuric acid, and the solution is subjected to oxidation-reduction titration by means of a standard solution of potassium permanganate.

The $Fe^{2+}$ content in magnetic material particles can be adjusted by controlling, for example, 1) the kind of the magnetic material particles, 2) the kind and loading of a non-magnetic material to be incorporated into the magnetic material particles, and 3) the kind and amount of a material with which the magnetic material particles are to be coated, and coating state thereof.

The constitution of magnetic toner preferable for achieving the object of the present invention will be described in detail below.

A binder resin in the magnetic toner of the present invention can be any one of various resin compounds that have been conventionally known as toner binder resins. Examples of the binder resin include a vinyl-based resin, a phenol resin, a natural resin-modified phenol resin, a natural resin-modified maleic resin, an acrylic resin, a methacrylic resin, polyvinyl acetate, a silicone resin, a polyester resin, polyurethane, a polyamide resin, a furan resin, an epoxy resin, a xylene resin, polyvinyl butyral, a terpene resin, a coumarone-indene resin, and a petroleum-based resin.

The binder resin in the magnetic toner of the present invention preferably has an acid value of preferably 1 to 50 mgKOH/g, or more preferably 4 to 40 mgKOH/g.

The inventors of the present invention have found that the charge amount and charging stability of magnetic toner are largely affected by a charge amount distribution on the surface of the magnetic toner, and an unevenness of the charge amount distribution may cause local leak of charge or charge-up, so the charging stability of the magnetic toner is apt to be reduced. The inventors have also found that the use of a binder resin having an acid value in the above range can reduce a difference between the mass of moisture adsorbed to the magnetic material particles exposed to the surface of the magnetic toner and the mass of moisture adsorbed to the binder resin, so the charge amount distribution on the surface of the magnetic toner can be uniform, as a result the above problems (the unevenness of the charge amount distribution) can be solved.

When the binder resin of the magnetic toner has an acid value of less than 1 mgKOH/g or in excess of 50 mgKOH/g, it becomes difficult to appropriately control the amount of moisture adsorbed to the magnetic toner. In addition, an environmental fluctuation of the chargeability of the magnetic toner tends to be large.

In addition, the binder resin has an OH value (hydroxyl value) of preferably 60 mgKOH/g or less, or more preferably 45 mgKOH/g or less. The reason for this is as follows. An environmental dependence of the charging property of the magnetic toner increases with rising number of terminal groups in molecular chain of the binder resin. As a result, the fluidity, electrostatic adherence, and developer surface resistance (owing to adsorbed water) of the magnetic toner are fluctuated depending on the environment, which may be responsible for a reduction in image quality.

The binder resin in the magnetic toner of the present invention preferably has at least a polyester unit. The toner surface formed from a binder resin having a polyester unit can retain a relatively large amount of adsorbed moisture because the polyester unit can enhance the water absorbing property of the binder resin. In the magnetic toner of the present invention containing a binder resin having a polyester unit, "amount and adsorption/desorption behavior of moisture adsorbed to a magnetic material particle exposed to the surface of the magnetic toner" and "amount and adsorption/desorption behavior of moisture adsorbed to the surface of a polyester resin" are similarity. Therefore, the charge amount distribution on the surface of the magnetic toner is easily made to be more uniform.

The term "polyester unit" refers to a unit derived from polyester. That is, the term "resin having a polyester unit" refers to a resin having a repeating unit having at least an ester bond.

When the amount of moisture contained in the binder resin of a magnetic toner is excessively large, the physical properties of the magnetic toner may greatly fluctuate owing to the environment. Therefore, a resin (preferably a resin having a polyester unit) having an acid value in the above range is preferably used as a binder resin of a magnetic toner, to adjust the ratio of the mass of moisture adsorbed to the magnetic toner to the mass of the magnetic toner at a relative vapor pressure of 50% to 0.05 mass % to 0.60 mass %.

When the ratio of the mass of adsorbed moisture to the mass of the magnetic toner is less than 0.05 mass %, charge-up tend to be occurred even if the magnetic material particles in the present invention are used. As a result, magnetic toner that is apt to cause detrimental effects on image quality such as fogging and scattering may be obtained. When the ratio of the mass of adsorbed moisture to the mass of the magnetic toner exceeds 0.60 mass %, chargeability of the magnetic toner tend to be reduced. As a result, magnetic toner unable to form an image having a sufficient density may be obtained.

The mass of moisture adsorbed to the magnetic toner can be measured in the same manner as in the mass of moisture adsorbed to magnetic material particles.

The amount of moisture adsorbed to the magnetic toner can be adjusted by, for example, 1) the kind, acid value, and hydroxyl value of the binder resin, and 2) the kind of the magnetic material particles and the amount of moisture adsorbed to the magnetic material particles.

The acid value of a binder resin can be determined through the following operations 1) to 5). The basic operation is according to JIS K0070.

1) An additive except the binder resin (polymer component) included in magnetic toner sample is removed. Alternatively, the content of the additive except the binder resin included in the magnetic toner sample is determined. 0.5 to 2.0 g of a pulverized product of magnetic toner or of the binder resin is precisely weighed. The mass of the binder resin included in the weighed sample is denoted by W (g).

2) The weighed sample is placed into a 300-ml beaker, and 150 ml of a mixed solution of toluene and ethanol (4:1 in mass ratio) are added to dissolve the sample.

3) A potentiometric titration is performed with a 0.1-mol/l solution of KOH in ethanol. Automatic titration using a potentiometric titration apparatus AT-400 (winworkstation) manufactured by Kyoto Denshi and an ABP-410 electrically-driven bullet can be employed for the titration.

4) The amount of the KOH solution for the titration is denoted by S (ml). On the other hand, a blank test with no resin added is performed in the same manner, and the amount of the KOH solution for the titration of the blank test is denoted by B (ml).

5) The acid value is calculated from the following equation. It should be noted that "f" in the following equation denotes the factor of KOH.

$$\text{Acid value (mgKOH/g)}=\{(S-B)\times f\times 5.61\}/W$$

An OH value can be determined through the following operations 1) to 8). The basic operation is according to JIS K0070.

1) An additive except the binder resin (polymer component) included in magnetic toner sample is removed. Alternatively, the content of the additive except the binder resin included in the magnetic toner sample is determined. 0.5 to 2.0 g of a pulverized product of magnetic toner or of the binder resin is precisely weighed. The weighed sample is placed into a 200-ml flat-bottomed flask.

2) 5 ml of an acetylating reagent (prepared by: placing a total of 25 g of acetic anhydride into a 100-ml flask; adding pyridine to have a total amount of 100 ml; and sufficiently stirring the mixture) are added into the flat-bottomed flask. When the sample is hardly dissolved, a small amount of pyridine is added or xylene or toluene is added to dissolve the sample.

3) A small funnel is placed on the port of the flask. Then, a portion of the flask up to a height of about 1 cm from the bottom is immersed into a glycerin bath at a temperature of 95 to 100° C. for heating. A circular plate of cardboard with a circular hole at its center is covered on the base of the neck of the flask in order to prevent the temperature of the neck of the flask from increasing owing to heat from the glycerin bath.

4) one hour after that, the flask is taken out of the glycerin bath and left standing to cool. 1 ml of water is added through the funnel, and the flask is shaken to decompose acetic anhydride.

5) The flask is heated in the glycerin bath again for an additional 10 minutes to complete the decomposition of acetic anhydride, and then the flask is left standing to cool. After that, the funnel and the wall of the flask are washed with 5 ml of ethanol.

6) Several droplets of a phenolphthalein solution as an indicator are added, and titration is performed with a 0.5-kmol/$m^3$ solution of potassium hydroxide in ethanol. The end point is defined in such a manner that a pale red color of the indicator lasts for about 30 seconds.

7) The operations 2) to 6) are performed as blank test with no resin added.

8) The OH value is calculated from the following equation.

$$A=[\{(B-C)\times 28.05\times f\}/S]+D$$

(In the equation, A represents a hydroxyl value (mgKOH/g); B, the amount (ml) of the 0.5-kmol/$m^3$ solution of potassium hydroxide in ethanol used for the blank test; C, the amount (ml) of the 0.5-kmol/$m^3$ solution of potassium hydroxide in ethanol used for the titration; f, the factor of the 0.5-kmol/$m^3$ solution of potassium hydroxide in ethanol; S, the amount (g) of the binder resin in the sample; and D, the acid value of the sample. The value "28.05" in the equation is the formula mass of potassium hydroxide (56.11×½).) The acid value and hydroxyl value of a binder resin can be adjusted by, for example, the kinds and loadings of monomer components constituting the binder resin.

Alcohol component(s) preferably accounts for 45 to 55 mol % of all the components of the polyester resin in the magnetic toner of the present invention, and acid component(s) preferably accounts for 55 to 45 mol % thereof.

Examples of the alcohol component include: ethylene glycol; propylene glycol; 1,3-butanediol; 1,4-butanediol; 2,3-butanediol; diethylene glycol; triethylene glycol; 1,5-petanediol; 1,6-hexanediol; neopentyl glycol; 2-ethyl-1,3-hexanediol; hydrogenated bisphenol A; bisphenol derivatives each represented by the following general formula (B); diols each represented by the following general formula (C); and polyhydric alcohols such as glycerin, sorbitol, and sorbitan.

(B)

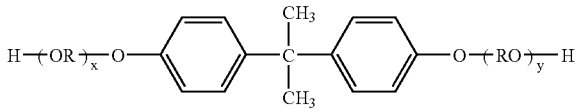

In the general formula (B), R represents an ethylene or propylene group, x and y each represent an integer of 1 or more, and an average value of x+y is 2 to 10.

(C)

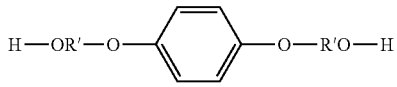

In the general formula (C), R's each represent any one of the following structural formulae, and R's may be identical to or different from each other.

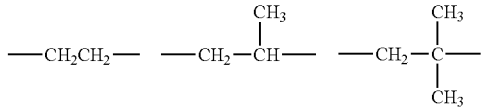

A carboxylic acid can be preferably exemplified as the acid component. Examples of a divalent carboxylic acid include: benzene dicarboxylic acids and anhydrides thereof such as phthalic acid, terephthalic acid, isophthalic acid, and phthalic anhydride; alkyl dicarboxylic acids such as succinic acid, adipic acid, sebacic acid, and azelaic acid, and anhydrides thereof; and unsaturated dicarboxylic acids such as fumaric acid, maleic acid, citraconic acid, and itaconic acid, and anhydrides thereof. Examples of a carboxylic acid which is trivalent or more include trimellitic acid, pyromellitic acid, and benzophenone tetracarboxylic acid, and anhydrides thereof.

Particularly preferable examples of the alcohol component of the polyester resin include the bisphenol derivatives each represented by the formula (B). Particularly preferable examples of the acid component include: dicarboxylic acids (such as phthalic acid, terephthalic acid, and isophthalic acid, and anhydrides thereof, succinic acid and n-dodecenylsuccinic acid, and anhydrides thereof, and fumaric acid, maleic acid, and maleic anhydride); and tricarboxylic acids (such as trimellitic acid and an anhydride thereof). This is because a magnetic toner using a polyester resin prepared from those acid and alcohol components as a binder resin has good fixability and excellent offset resistance.

Any one of the following vinyl-based resins may be used as the binder resin in the magnetic toner of the present invention.

Examples of the vinyl-based resin include those using vinyl-based monomers such as: styrene; styrene derivatives such as o-methylstyrene, m-methylstyrene, p-methylenestyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylene unsaturated monoolefins such as ethylene, propylene, butylene, and isobutylene; unsaturated polyenes such as butadiene; vinyl halides such as vinyl chloride, vinylidene chloride, vinyl bromide, and vinyl fluoride; vinyl esters such as vinyl acetate, vinyl propionate, and vinyl benzoate; x-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; acrylic or methacrylic acid derivatives such as acrylonitrile, methacrylonitrile, and acrylamide; esters of α,β-unsaturated acids; diesters of dibasic acids; acrylic acid and methacrylic acid, and α- or β-alkyl derivatives thereof such as α-ethyl acrylate, crotonic acid, cinnamic acid, vinyl acetate, isocrotonic acid, and angelic acid; unsaturated dicarboxylic acids such as fumaric acid, maleic acid, citraconic acid, alkenylsuccinic acid, itaconic acid, mesaconic acid, dimethylmaleic acid, and dimethylfumaric acid, and monoester derivatives and anhydrides thereof.

The vinyl-based resin described above uses one or two or more of the vinyl-based monomers described above. Of those, a combination of monomers providing a styrene-based copolymer or a styrene-acrylic copolymer is preferable.

The binder resin in the magnetic toner of the present invention may be a polymer or copolymer cross-linked as required with such cross-linkable monomer as exemplified below.

A monomer having two or more cross-linkable unsaturated bonds can be used as the cross-linkable monomer. Various monomers as shown below have been conventionally known as such cross-linkable monomers, and any one of them can be suitably used for the magnetic toner of the present invention.

Examples of the cross-linkable monomer include: aromatic divinyl compounds such as divinylbenzene and divinylnaphthalene; diacrylate compounds bonded with alkyl chains such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by changing the term "acrylate" in these compounds into "methacrylate"; diacrylate compounds bonded with alkyl chains containing ether bonds such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate, and compounds obtained by changing the term "acrylate" in these compounds into "methacrylate"; diacrylate compounds bonded with chains containing aromatic groups and ether bonds such as polyoxyethylene(2)-2,2-bis(4-hydroxyphenyl)propane diacrylate and polyoxyethylene(4)-2,2-bis(4-hydroxyphenyl)propane diacrylate, and compounds obtained by changing the term "acrylate" in these compounds into "methacrylate"; and polyester-type diacrylates such as MANDA (Nippon Kayaku Co., Ltd.).

Examples of a polyfunctional cross-linking agent having three or more cross-linkable unsaturated bonds include: pentaerythritol triacrylate, trimethylolethane triacrylate, trimethylolpropane triacrylate, tetramethylolmethane tetraacrylate, and oligoester acrylate, and compounds obtained by changing the term "acrylate" in these compounds into "methacrylate"; triallylcyanurate; and triallyltrimellitate.

The usage of any one of those cross-linking agents is preferably adjusted depending on, for example, the kind of a monomer to be cross-linked and desired physical properties of a binder resin to be produced. In general, the usage is 0.01 to 10.00 parts by mass (preferably 0.03 to 5.00 parts by mass) based on 100 parts by mass of other monomer components constituting the binder resin.

Out of those cross-linkable monomers, aromatic divinyl compounds (especially divinylbenzene) and diacrylate compounds including chain containing aromatic group(s) and ether bond(s) are preferably used in the view of fixability and offset resistance of developers.

In the present invention, a resin such as a homopolymer or copolymer of a vinyl-based monomer, polyester, polyurethane, an epoxy resin, polyvinyl butyral, rosin, modified rosin, a terpene resin, a phenol resin, an aliphatic or alicyclic hydrocarbon resin, or an aromatic petroleum resin can be mixed as required with the binder resin described above. When a mixture of two or more kinds of resins is used as a binder resin, the mixture preferably includes the two or more kinds of resins individually having different molecular weight at an appropriate ratio.

The binder resin to be used in the present invention has a glass transition temperature (Tg) of preferably 45 to 80° C., or more preferably 55 to 70° C., a number-average molecular weight (Mn) of preferably 2,500 to 50,000, and a weight-average molecular weight (Mw) of 10,000 to 1,000,000.

The number-average molecular weight and weight-average molecular weight of a binder resin can be determined as follows. First, the binder resin is dissolved into tetrahydrofuran (THF). A number of counts (retention time) is obtained from gel permeation chromatography (GPC) analysis of the THF solution. On the other hand, an GPC calibration curve is obtained from several kinds of monodisperse polystyrene standard samples. The molecular weights can be determined from the number of counts and logarithmic values of the calibration curve. The molecular weight of the binder resin can be adjusted by, for example, polymerization conditions, whether a cross-linking agent is used, and the condition of kneading the binder resin.

In general, the binder resin has a theoretical glass transition temperature of 45 to 80° C. "a theoretical glass transition temperature" is defined in the publication Polymer Handbook, 2nd edition, III, p 139 to 192 (published by John Wiley & Sons). The theoretical glass transition temperature of the binder resin in the present invention can be adjusted by selecting constituents (polymerizable monomers) of the binder resin. In addition, the glass transition temperature of a binder resin can be measured in accordance with ASTM D3418-82 by means of a differential scanning calorimeter such as DSC-7 (manufactured by Perkin Elmer Co., Ltd.) or DSC2920 (manufactured by TA Instruments Japan Inc.). When the glass transition temperature of a binder resin is lower than the above range, storage stability of magnetic toner may be insufficient. On the other hand, when the glass transition temperature of the binder resin is higher than the above range, the fixability of the magnetic toner may be insufficient.

A method of preparing a binder resin composed of a vinyl-based polymer or copolymer is not particularly limited, and any one of conventionally known methods can be employed. For example, a polymerization method such as block polymerization, solution polymerization, suspension polymerization, or emulsion polymerization can be employed. When a carboxylic acid monomer or an acid anhydride monomer is used, block polymerization or solution polymerization method is preferably employed depending on the nature of the acid monomer to be used.

The magnetic toner of the present invention may contain a wax.

Examples of a wax that can be used in the present invention include: aliphatic hydrocarbon-based waxes such as low-molecular-weight polyethylene, low-molecular-weight polypropylene, a polyolefin copolymer, a polyolefin wax, a microcrystalline wax, a paraffin wax, and a Fischer-Tropsch wax; oxides of aliphatic hydrocarbon-based waxes such as an oxidized polyethylene wax, and block copolymers thereof; plant-based waxes such as a candelilla wax, a carnauba wax, a haze wax, and a jojoba wax; animal-based waxes such as a bees wax, lanolin, and a spermaceti wax; mineral-based waxes such as ozokerite, ceresin, and petrolatum; waxes mainly composed of aliphatic esters such as a montanic acid ester wax and a castor wax; and partially or wholly deacidified aliphatic esters such as a deacidified carnauba wax.

The examples of a wax further include: saturated linear aliphatic acids such as palmitic acid, stearic acid, montanic acid, and a long-chain alkylcarboxylic acid; unsaturated aliphatic acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and an alkylalcohol having a longer alkyl chain; polyhydric alcohols such as sorbitol; aliphatic amides such as linoleic amide, oleic amide, and lauric amide; saturated aliphatic bisamides such as methylene-bisstearic amide, ethylene-biscapric amide, ethylene-bislauric amide, and hexamethylene-bisstearic amide; unsaturated aliphatic amides such as ethylene-bisoleic amide, hexamethylene-bisoleic amide, N,N'-dioleyladipic amide, and N,N'-dioleylsebacic amide; aromatic bisamides such as m-xylene-bisstearic amide and N,N'-distearylisophthalic amide; aliphatic acid salts (generally called metallic soaps) such as calcium stearate, calcium laurate, zinc stearate, and magnesium stearate; waxes obtained by grafting aliphatic hydrocarbon-based waxes with vinyl-based monomers such as styrene and acrylic acid; partially esterified products between aliphatic acids and polyhydric alcohols, such as behenic acid monoglyceride; and methyl ester compounds having hydroxyl group(s) obtained by hydrogenating vegetable oil and fat.

1) Those waxes whose molecular weight distributions are sharpened by means of press sweating, a solvent method, recrystallization, vacuum distillation, supercritical gas extraction, or melt crystallization, or 2) those waxes from which low-molecular-weight solid aliphatic acids, low-molecular-weight solid alcohols, low-molecular-weight solid compounds, and other impurities are removed are also preferably used.

The magnetic toner of the present invention may contain a charge control agent.

Specific examples of a negative charge control agent include: metal compounds of monoazo dyes described in, for example, JP 41-20153 B, JP 44-6397 B, and JP 45-26478 B; nitrohumic acid and a salt thereof described in JP 50-133838 A; dyes such as C.I. 14645; metal (such as Zn, Al, Co, Cr, Fe, and Zr) compounds of salicylic acid, naphthoic acid, and dicarboxylic acid described in, for example, JP 55-42752 B, JP 58-41508 B, and JP 59-7385 B; copper sulfonated phthalocyanine pigments; styrene oligomers into which a nitro group and a halogen are introduced; and chlorinated paraffin. Azo-based metal compounds each represented by the following general formula (I) and basic organic acid metal compounds each represented by the following general formula (II), each of which has excellent dispersibility and has effects on the stabilization of an image density and on a reduction in fogging, are particularly preferable.

(I)

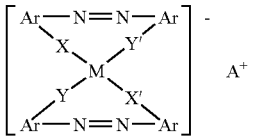

In the general formula (I), M represents a coordination center metal selected from Cr, Co, Ni, Mn, Fe, Ti, and Al. Ar represents an arylene group such as a phenylene group or a naphthylene group, and may have a substituent. Examples of the substituent include a nitro group, a halogen, a carboxyl group, an anilide group, an alkyl group having 1 to 18 carbon atoms, and an alkoxy group having 1 to 18 carbon atoms. X, X', Y, and Y' each represent —O—, —CO—, —NH—, or —NR— (where R represents an alkyl group having 1 to 4 carbon atoms). $A^+$ represents a hydrogen ion, a sodium ion, a potassium ion, an ammonium ion, or an aliphatic ammonium ion.

(II)

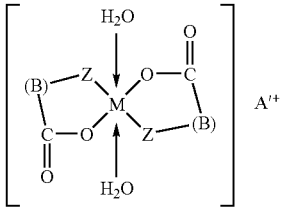

In the general formula (II), M represents a coordination center metal selected from Cr, Co, Ni, Mn, Fe, Ti, Zr, Zn, Si, B, and Al. (B)s each represent any one of the following structural formulae (1) to (8) each of which may have a substituent(X) such as an alkyl group, and (B)s may be identical to or different from each other. $A'^+$ represents a hydrogen ion, a sodium ion, a potassium ion, an ammonium ion, or an aliphatic ammonium ion. Zs each represent —O— or the following structural formula (9), and Zs may be identical to or different from each other.

(1)

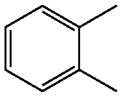

(2)

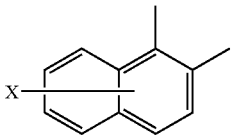

(3)

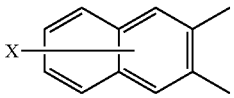

(4)

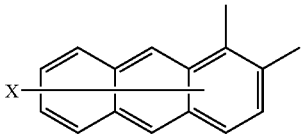

(5)

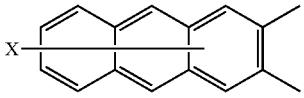

-continued (6)

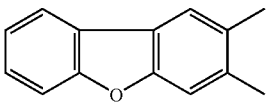

-continued (7)

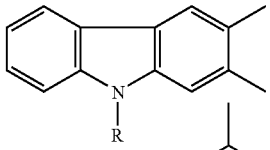

(8)

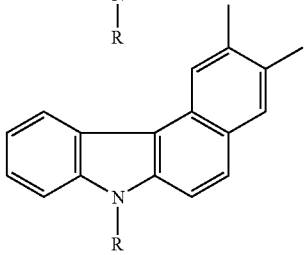

(9)

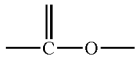

In the formulae (7) and (8), R represents a hydrogen atom, an alkyl group having 1 to 18 carbon atoms, or an alkenyl group having 2 to 18 carbon atoms.

Of those, azo-based metal compounds each represented by the general formula (I) are more preferable, and azo-based iron compounds each having Fe as a center metal and each represented by the following formula (III) or (IV) are most preferable.

(III)

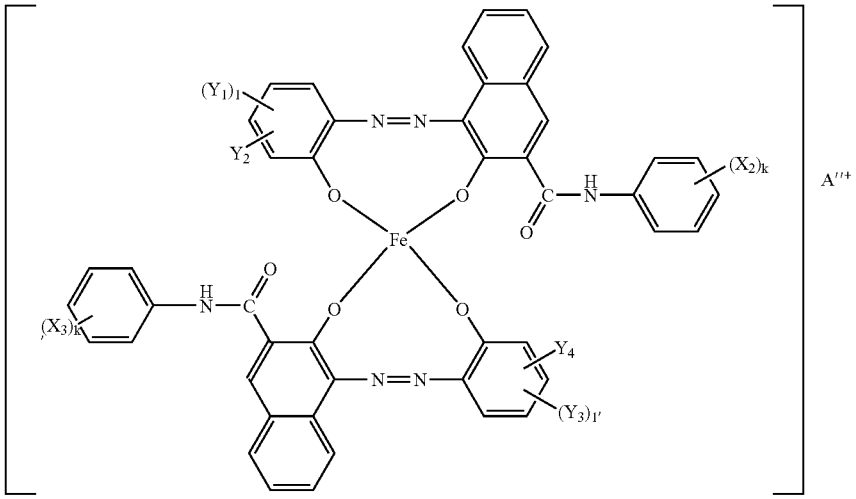

In the general formula (III), $X_2$ and $X_3$ each represent a hydrogen atom, a lower alkyl group, a lower alkoxy group, a nitro group, or a halogen atom. k and k' each represent an integer of 1 to 3. $Y_1$ and $Y_3$ each represent a hydrogen atom, an alkyl group having 1 to 18 carbon atoms, an alkenyl group having 2 to 18 carbon atoms, a sulfonamide group, a mesyl group, a sulfonic group, a carboxyester group, a hydroxy group, an alkoxy group having 1 to 18 carbon atoms, an acetylamino group, a benzoyl group, an amino group, or a halogen atom. 1 and 1' each represent an integer of 1 to 3. $Y_2$ and $Y_4$ each represent a hydrogen atom or a nitro group. $A''^{+}$ represents an ammonium ion, a sodium ion, a potassium ion, a hydrogen ion, or a mixed ion of them. $A''^{+}$ preferably has 75 to 98 mol % of an ammonium ion. $X_2$ and $X_3$, k and k', $Y_1$ and $Y_3$, 1 and 1', or $Y_2$ and $Y_4$ may be identical to or different from each other.

(IV)

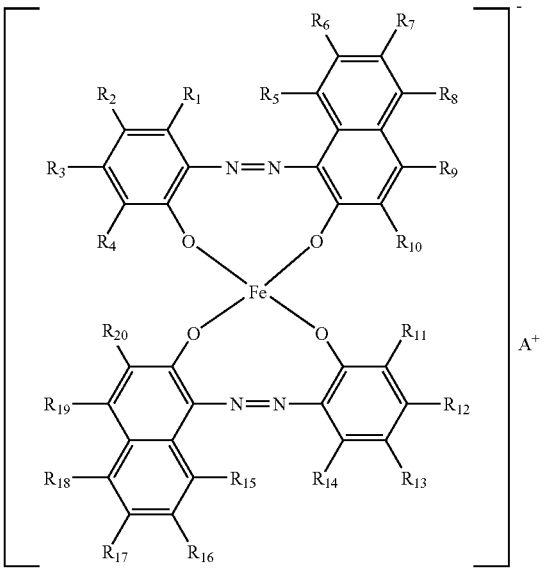

In the general formula (IV), $R_1$ to $R_{20}$ each represent a hydrogen atom, a halogen atom, or an alkyl group, and may be identical to or different from one another. $A^{+}$ represents an ammonium ion, a sodium ion, a potassium ion, a hydrogen ion, or a mixed ion of them.

Next, specific examples of the azo-based iron compounds each represented by the general formula (III) will be shown.

Azo-based iron compound (1)

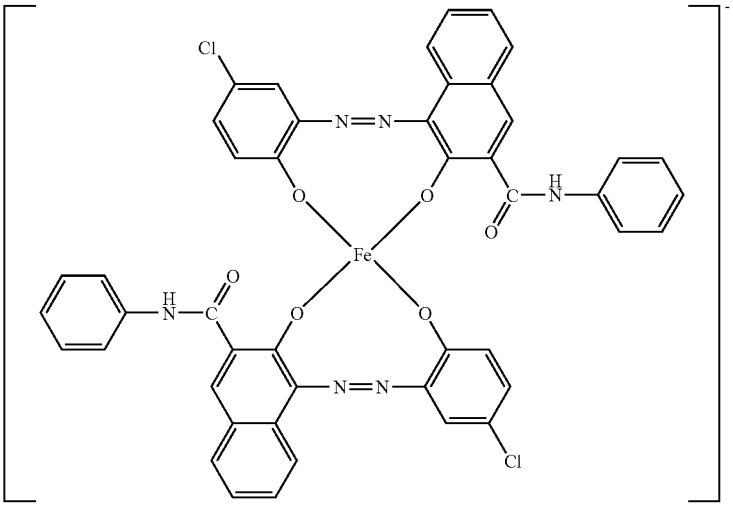

$NH_4^{+}$, $H^{+}$, $Na^{+}$, $K^{+}$, or a mixed ion of them

-continued
Azo-based iron compound (2)
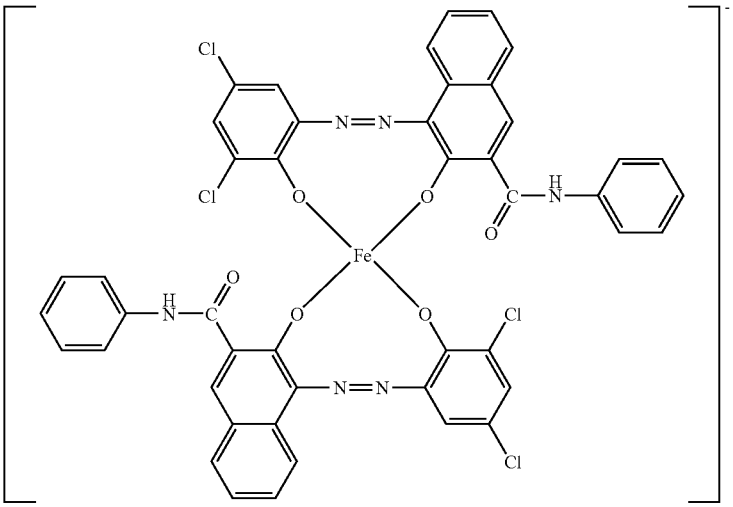
$NH_4^+$, $H^+$, $Na^+$, $K^+$, or a mixed ion of them
Azo-based iron compound (3)
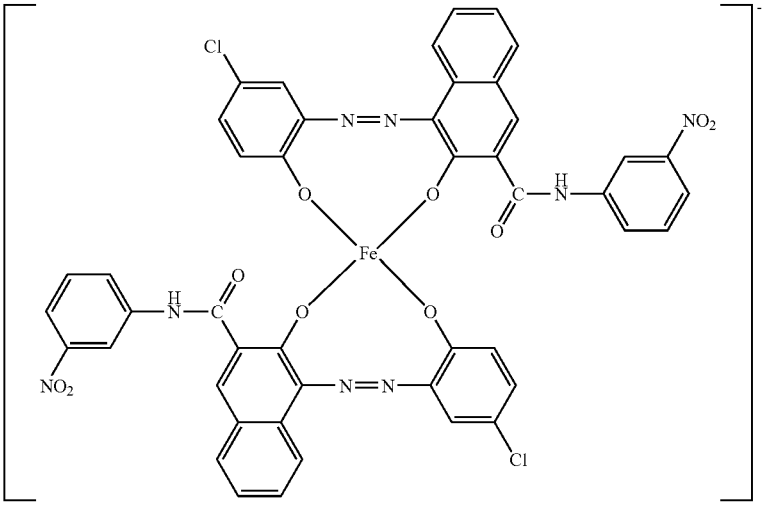
$NH_4^+$, $H^+$, $Na^+$, $K^+$, or a mixed ion of them
Azo-based iron compound (4)
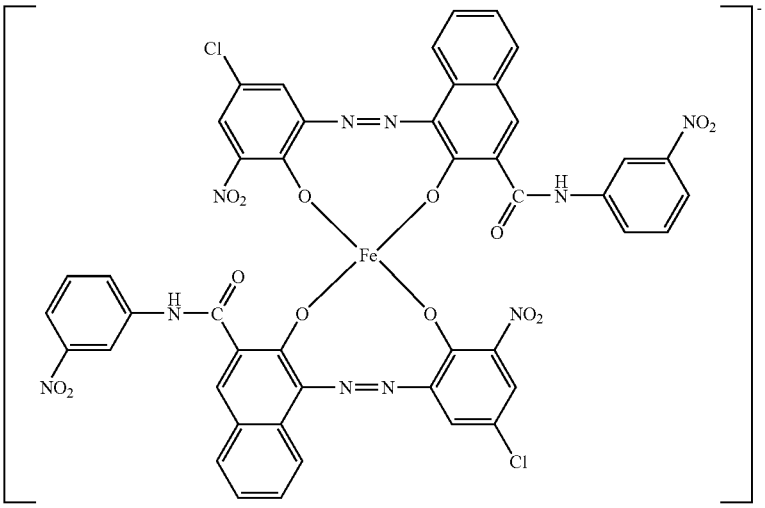
$NH_4^+$, $H^+$, $Na^+$, $K^+$, or a mixed ion of them -continued
Azo-based iron compound (5)
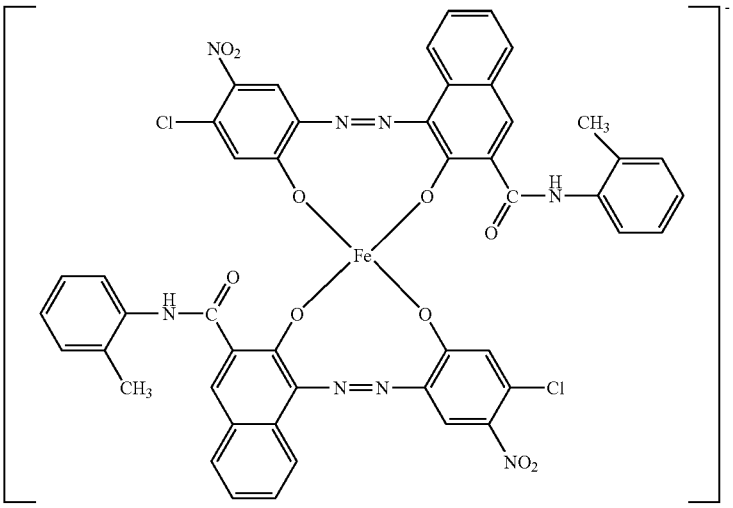
$NH_4^+$, $H^+$, $Na^+$, $K^+$, or a mixed ion of them
Azo-based iron compound (6)
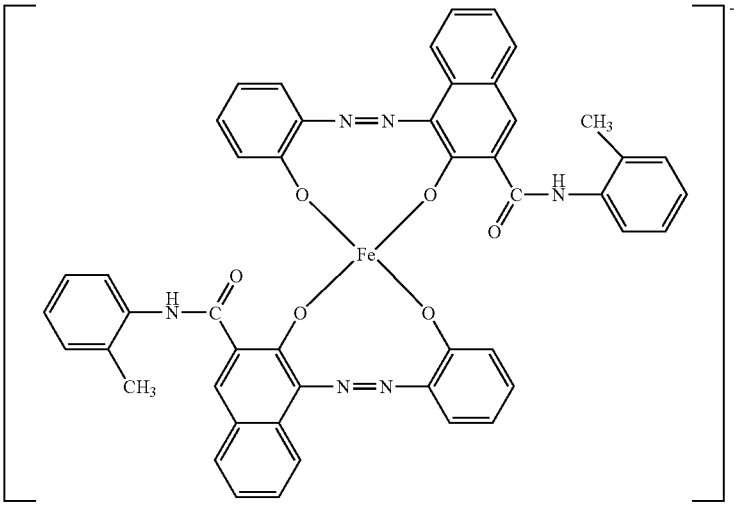
$NH_4^+$, $H^+$, $Na^+$, $K^+$, or a mixed ion of them
Specific examples of charge control agents having structures represented by the formulae (I), (II), and (IV) are shown below.
Azo-based metal compound (7)
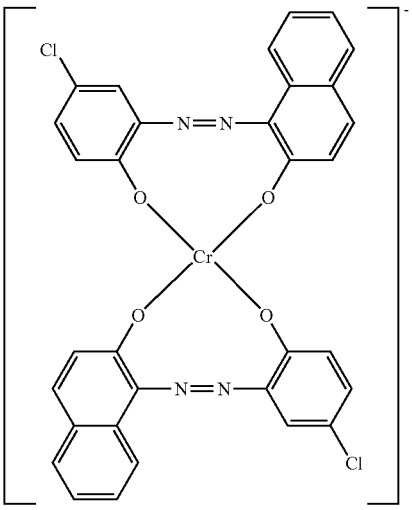
$NH_4^+$, $H^+$, $Na^+$, $K^+$, or a mixed ion of them -continued
Azo-based metal compound (8)
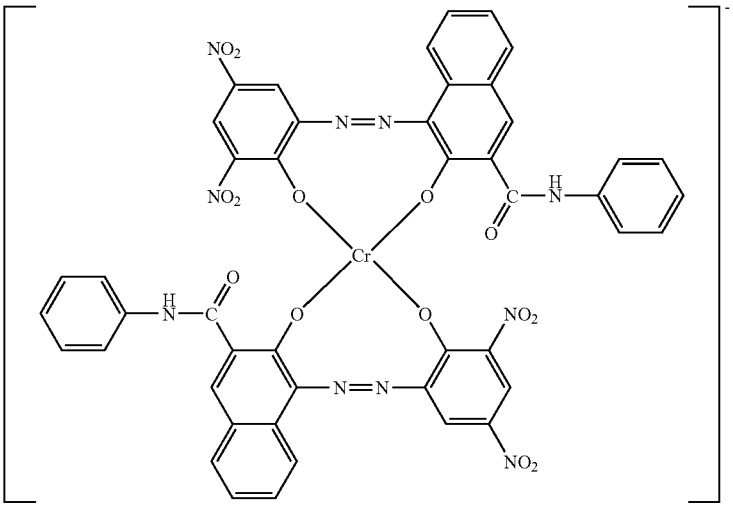
$NH_4^+$, $H^+$, $Na^+$, $K^+$, or a mixed ion of them
Basic organic acid metal compound (9)
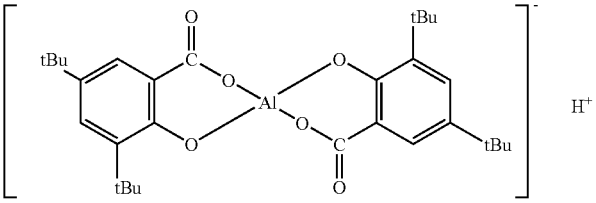
$H^+$
Basic organic acid metal compound (10)
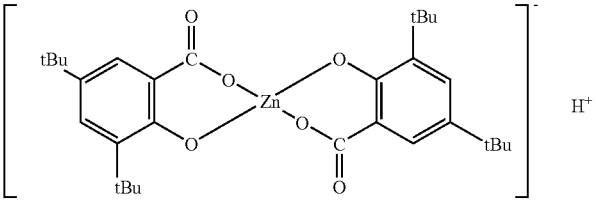
$H^+$
Basic organic acid metal compound (11)
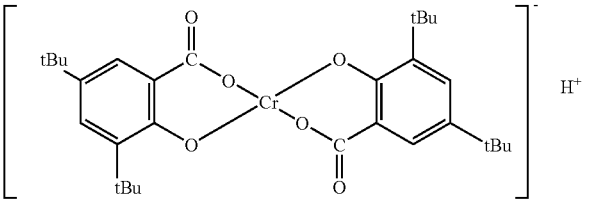
$H^+$
Basic organic acid metal compound (12)
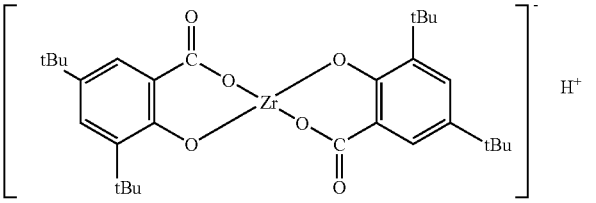
$H^+$ -continued Azo-based iron compound (13)

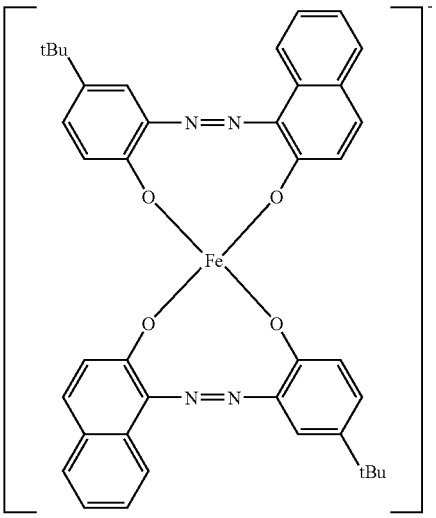

$NH_4^+$, $H^+$, $Na^+$, $K^+$, or a mixed ion of them

It should be noted that tBu in each of the formulae represents a tertiary butyl group.

Each of those metal complex compounds may be used alone, or two or more of them may be used in combination. The usage of any one of those charge control agents is preferably 0.1 to 5.0 parts by mass based on 100 parts by mass of a binder resin in the view of the charge amount of magnetic toner.

Meanwhile, examples of a charge control agent for controlling toner to be positively-chargeable include: nigrosine and modified products thereof with aliphatic metal salts, and so on; quaternary ammonium salts such as tributylbenzyl ammonium-1-hydroxy-4-naphtosulfonate and tetrabutyl ammonium tetrafluoroborate, and analogs thereof, which are onium salts such as phosphonium salt, and lake pigments thereof; triphenylmethane dyes and lake pigments thereof (examples of lake agents include phosphotungstenic acid, phosphomolybdic acid, phosphotungsten molybdic acid, tannic acid, lauric acid, gallic acid, ferricyanide, and ferrocyanide); metal salts of higher aliphatic acids; diorganotin oxides such as dibutyltin oxide, dioctyl tin oxide, and dicyclohexyl tin oxide; and diorganotin borates such as dibutyl tin borate, dioctyl tin borate, and dicyclohexyl tin borate. Each of them may be used alone, or two or more of them may be used in combination.

Preferable examples of a charge control agent for negative charging include: SPILON BLACK TRH, T-77, and T-95 (Hodogaya Chemical); and BONTRON (registered trademark) S-34, S-44, S-54, E-84, E-88, and E-89 (Orient Chemical Industries, Ltd.). Preferable examples of a charge control agent for positive charging include: TP-302 and TP-415 (Hodogaya Chemical); BONTRON (registered trademark) N-01, N-04, N-07, and P-51 (Orient Chemical Industries, Ltd.); and COPY BLUE PR (Clariant).

In addition, the magnetic toner of the present invention preferably contains inorganic fine powder or hydrophobic inorganic fine powder. For example, silica fine powder is preferably externally added to the magnetic toner of the present invention.

The silica fine powder to be added to (preferably externally added to) the magnetic toner of the present invention may be any one of: so-called dry silica (also referred to as dry-method silica or fumed silica) produced by vapor phase oxidation of a silicon halide compound; and so-called wet silica produced from, for example, water glass. Particularly, dry silica having a small number of silanol groups on its surface and in it and containing no production residue is preferable.

Furthermore, the silica fine powder to be used in the present invention is preferably subjected to a hydrophobic treatment. Hydrophobicity is imparted to silica fine powder by chemically treating the silica fine powder with an organic silicon compound and so on, which can react with or physically adsorb the silica fine powder. An example of a preferable method includes a method involving 1) treating dry silica fine powder produced by the vapor phase oxidation of a silicon halide compound with a silane compound, and 2) treating with an organic silicon compound such as silicone oil after or simultaneously with the treating 1).

Examples of the silane compound used for a hydrophobic treatment include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilanemercaptan, trimethylsilylmercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, and 1,3-diphenyltetramethyldisiloxane.

An example of the organic silicon compound includes silicone oil. Silicone oil preferably has a viscosity of $3\times10^{-5}$ to $1\times10^{-3}$ $m^2/s$ at 25° C. Examples of preferable silicone oil include a dimethyl silicone oil, a methylhydrogen silicone oil, a methylphenyl silicone oil, an α-methylstyrene-modified silicone oil, a chlorophenyl silicone oil, and a fluorine-modified silicone oil.

Treatment with silicone oil can be performed by, for example, 1) directly mixing silica fine powder treated with a silane compound and silicone oil by means of a mixer such as a Henschel mixer, or 2) injecting silicone oil into silica fine powder as base particle. Alternatively, the treatment can also be performed by: dissolving or dispersing silicone oil into an appropriate solvent; mixing the solution with silica fine powder as base particle; and removing the solvent.

Any other external additive than silica fine powder may be added as required to the magnetic toner of the present invention. Examples of such other external additive include resin fine particles and inorganic fine particles serving as a charging aid, a conductivity imparting agent, a fluidity imparting agent, an anti-caking agent, a lubricant, an abrasive, and the like. Any one of them may be used in a small amount.

Specific examples of the other external additive include: lubricants such as polyethylene fluoride, zinc stearate, and polyvinylidene fluoride (in particular, polyvinylidene fluoride); abrasives such as cerium oxide, silicon carbide, and strontium titanate (in particular, strontium titanate); fluidity imparting agents such as titanium oxide and aluminum oxide (in particular, those having hydrophobicity); anti-caking agents; conductivity imparting agents such as carbon black, zinc oxide, antimony oxide, and tin oxide; and developability improvers such as white and black fine particles having opposite polarity.

The amount of inorganic fine powder (preferably, hydrophobic inorganic fine powder) to be mixed with the magnetic toner is preferably 0.1 to 5.0 parts by mass (more preferably 0.1 to 3.0 parts by mass) based on 100 parts by mass of the magnetic toner.

A mixture containing at least a binder resin and magnetic material particles is used as a material for producing the magnetic toner of the present invention. In addition, other additives such as a wax, a charge control agent, and a conventionally known colorant are used as required.

A method of producing the magnetic toner of the present invention is not particularly limited, and any one of conventionally known methods can be adopted. For example, the magnetic toner of the present invention can be obtained by: sufficiently mixing the materials for the magnetic toner described above by means of a mixer such as a Henschel mixer or a ball mill; melting and kneading the mixture by means of a heat kneader such as a roll, a kneader, or an extruder to make resins compatible with each other; dispersing or dissolving magnetic material particles, and a pigment or a dye into the kneaded product; cooling the resultant for solidification; pulverizing the solidified product; classifying the pulverized product; and mixing the classified product with an external additive such as inorganic fine powder as required by means of the above described mixer.

Examples of the mixer include: HENSCHEL MIXER (manufactured by Mitsui Mining Co., Ltd.); SUPER MIXER (manufactured by Kawata); RIBOCORN (manufactured by Okawara Corporation); NAUTA MIXER, TURBULIZER, and CYCLOMIX (manufactured by Hosokawa Micron Corporation); SPIRAL PIN MIXER (manufactured by Pacific Machinery & and Engineering Co., Ltd.); and LODIGE MIXER (manufactured by Matsubo Corporation).

Examples of the kneader include: KRC KNEADER (manufactured by Kurimoto, Ltd.); BUSS CO-KNEADER (manufactured by Buss); TEM EXTRUDER (manufactured by Toshiba Machine Co., Ltd.); TEX BIAXIAL EXTRUDER (manufactured by Japan Steel Works Ltd.); PCM KNEADER (manufactured by Ikegai); THREE-ROLL MILL, MIXING ROLL, and KNEADER (manufactured by Inoue Manufacturing Co., Ltd.); KNEADEX (manufactured by Mitsui Mining Co., Ltd.); MS PRESSURE KNEADER and KNEADER-RUDER (manufactured by Moriyama Manufacturing Co., Ltd.); and BANBURY MIXER (manufactured by Kobe Steels, Ltd.).

Examples of a pulverizer include: COUNTER JET MILL, MICRONJET, and INOMIZER (manufactured by Hosokawa Micron Corporation); IDS MILL and PJM JET PULVERIZER (manufactured by Nippon Pneumatic Mfg, Co., Ltd.); CROSS JET MILL (manufactured by Kurimoto, Ltd.); URUMAX (manufactured by Nisso Enginerring Co., Ltd.); SK JET O MILL (manufactured by Seishin Enterprise Co., Ltd.); KRYPTRON SYSTEM (manufactured by Kawasaki Heavy Industries); TURBO MILL (manufactured by Turbo Kogyo Co., Ltd.); and SUPER ROTOR (manufactured by Nisshin Engineering Inc.).

Examples of a classifier include: CLASSIEL, MICRON CLASSIFIER, and SPEDIC CLASSIFIER (manufactured by Seishin Enterprise Co., Ltd.); TURBO CLASSIFIER (manufactured by Nisshin Engineering Inc.); MICRON SEPARATOR, TURBOPLEX (ATP), and TSP SEPARATOR (manufactured by Hosokawa Micron Corporation); ELBOW JET (manufactured by Nittetsu Mining Co., Ltd.); DISPERSION SEPARATOR (manufactured by Nippon Pneumatic Mfg, Co., Ltd.); and YM MICROCUT (manufactured by Yasukawa Shoji).

Examples of a sieving device used for sieving coarse particles and the like include: ULTRASONIC (manufactured by Koei Sangyo Co., Ltd.); RESONASIEVE and GYROSIFTER (manufactured by Tokuju Corporation); VIBRASONIC SYSTEM (manufactured by Dalton Corporation); SONICLEAN (manufactured by Shintokogio Ltd.); TURBO SCREENER (manufactured by Turbo Kogyo Co., Ltd.); MICROSIFTER (manufactured by Makino mfg Co., Ltd.); and CIRCULAR VIBRATING SCREEN.

The magnetic toner of the present invention preferably has a weight average particle size of 4.5 μm to 10.0 μm. A magnetic toner having a weight average particle size in excess of 10.0 μm is not preferable because it is difficult to achieve high image quality owing to the sizes of the toner particles themselves. A magnetic toner having a weight average particle size of less than 4.5 μm is not preferable because such toner may accelerate fogging and scattering even when the magnetic material particles of the present invention are used.

The weight average particle size can be measured by means of COULTER MULTISIZER II (manufactured by Beckman Coulter, Inc, trade name) as a particle size measuring device. For example, a COULTER MULTISIZER II can be connected to an INTERFACE (manufactured by Nikkaki Bios Co., Ltd.) and a personal computer PC9801 (manufactured by NEC Corporation, trade name) for outputting a number distribution and a volume distribution.

1% aqueous solution of NaCl prepared by dissolving extra-pure sodium chloride into water can be used as an electrolyte for preparing a test sample. For example, an ISOTON R-II (manufactured by Coulter Scientific Japan, Co., trade name) may also be used as the electrolyte.

The test sample can be prepared by: adding 0.1 to 5.0 ml of a surfactant (preferably alkylbenzene sulfonate) as a dispersant to 100 to 150 ml of the electrolyte; adding 2 to 20 mg of a developer sample to the mixture; and subjecting the resultant to a dispersion treatment by means of an ultrasonic disperser for about 1 to 3 minutes. A 100-μm aperture can be used as an aperture in the measurement of the weight average particle size by means of the COULTER MULTISIZER.

The number of particles belonged to each of channels (having a particle size of 2 μm or more) and the volume of each of particles are measured to calculate a volume distribution and a number distribution. The weight average particle size can be determined from the volume distribution (the central value of each channel is defined as a representative value).

The weight average particle size of the magnetic toner can be adjusted by, for example, the pulverization and classification of the magnetic toner, and mixing of a classified product having an appropriate particle size.

The magnetic toner of the present invention is suitably used as a one-component developer. For example, the magnetic toner of the present invention can be used for image formation by means of a conventionally known image forming apparatus for a one-component developer such as 1) one having a developing device for one-component jumping development or 2) one having a developing and cleaning device that can carry out supply of magnetic toner to a photosensitive member (development) and recovery of transfer residual toner from the photosensitive member. The magnetic toner of the present invention can also be suitably used for a process cartridge integrally attached to the main body of an image forming apparatus, the process cartridge having at least a developing device storing the magnetic toner of the present invention and a photosensitive member on which an electrostatic latent image to be developed as a toner image with the magnetic toner of the present invention is formed.

Hereinafter, the present invention will be described by way of examples. However, the present invention is not limited to these examples.

PRODUCTION EXAMPLE 1 OF MAGNETIC MATERIAL PARTICLES

An aqueous solution of ferrous sulfate was mixed with an aqueous solution of 0.965 equivalent of sodium hydroxide based on $Fe^{2+}$, to prepare an aqueous solution of ferrous salt containing Fe $(OH)_2$.

To the resultant, soda silicate of 0.3 mass % in a Si element equivalent based on a Fe element was added. Next, the aqueous solution of ferrous salt containing $Fe(OH)_2$ was aerated at a temperature of 90° C. and at a pH of 6.5 to be subjected to oxidation reaction. Thereby, a suspension was obtained.

Furthermore, an aqueous solution (into which 0.1 mass % of soda silicate had been dissolved) of 1.05 equivalents of sodium hydroxide in a Si element equivalent based on an Fe element was added to the suspension. The mixture was subjected to an oxidation reaction at a pH of 9.0 while being heated at a temperature of 90° C., and was then washed, filtered, and dried according to an ordinary method to prepare core magnetic material particles A.

Next, the core magnetic material particles A were dispersed into water to prepare an aqueous suspension having a concentration of 100 g/l, and the aqueous suspension was held at 70° C. An aqueous solution of sodium hydroxide or dilute sulfuric acid was added to adjust the pH of the aqueous suspension to 5.0. An aqueous solution of titanium sulfate having a $TiO_2$ concentration of 80 g/l was added in an amount equivalent to 1.0 mass % in terms of $TiO_2/Fe_3O_4$ to the aqueous suspension over about 1 hour while the aqueous suspension was stirred. At this time, an aqueous solution of sodium hydroxide was simultaneously added to maintain the pH of the aqueous suspension at 5.0. Next, an aqueous solution of sodium hydroxide was added to adjust the pH of the aqueous suspension to neutral. The resultant was washed, filtered, dried, and shredded according to an ordinary method to produce magnetic material particles 1 coated with $TiO_2$. The magnetic material particles 1 had an average particle size of 0.15 μm. Table 1 shows the physical properties of the magnetic material particles.

PRODUCTION EXAMPLE 2 OF MAGNETIC MATERIAL PARTICLES

Magnetic material particles 2 coated with $TiO_2$ were produced in the same manner as in Production Example 1 of Magnetic Material Particles except that an aqueous solution of titanium sulfate was added in an amount equivalent to 5.3 mass % in terms of $TiO_2/Fe_3O_4$. Table 1 shows the physical properties of the magnetic material particles 2.

PRODUCTION EXAMPLE 3 OF MAGNETIC MATERIAL PARTICLES

Magnetic material particles 3 coated with $TiO_2$ and having an average particle size of 0.12 μm were produced in the same manner as in Production Example 1 of Magnetic Material Particles except that: the average particle size of the core magnetic material particles before being coated with $TiO_2$ was adjusted to 0.12 μm; and an aqueous solution of titanium sulfate was added in an amount equivalent to 9.0 mass % in terms of $TiO_2/Fe_3O_4$. Table 1 shows the physical properties of the magnetic material particles 3.

PRODUCTION EXAMPLE 4 OF MAGNETIC MATERIAL PARTICLES

Magnetic material particles 4 coated with $TiO_2$ were produced in the same manner as in Production Example 1 of Magnetic Material Particles except that: the pH in the production process of the core magnetic material particles before being coated with $TiO_2$ was adjusted to obtain the core magnetic material particles having an average particle size of 0.27 μm and each having an octahedral shape; and an aqueous solution of titanium sulfate was added in an amount equivalent to 0.5 mass % in terms of $TiO_2/Fe_3O_4$. Table 1 shows the physical properties of the magnetic material particles 4.

PRODUCTION EXAMPLES 5 TO 7 OF MAGNETIC MATERIAL PARTICLES

Magnetic material particles 5 to 7 coated with $TiO_2$ were produced in the same manner as in Production Example 1 of Magnetic Material Particles except that: the average particle size of the core magnetic material particles before being coated with $TiO_2$ was adjusted; and the addition amount of an aqueous solution of titanium sulfate was changed. Table 1 shows the physical properties of the magnetic material particles 5 to 7.

PRODUCTION EXAMPLES 8 AND 9 OF MAGNETIC MATERIAL PARTICLES FOR COMPARISON

Magnetic material particles 8 and 9 for comparison were produced in the same manner as in Production Example 1 of Magnetic Material Particles except that: the average particle size of the core magnetic material particles before being coated with $TiO_2$ was adjusted; and the addition amount of an aqueous solution of titanium sulfate was changed. Table 1 shows the physical-properties of the magnetic material particles 8 and 9.

PRODUCTION EXAMPLES 10 OF MAGNETIC MATERIAL PARTICLES FOR COMPARISON

Magnetic material particles 10 for comparison were produced in the same manner as in Production Example 4 of Magnetic Material Particles except that an aqueous solution of titanium sulfate was added in an amount equivalent to 9.8 mass % in terms of $TiO_2/Fe_3O_4$. Table 1 shows the physical properties of the magnetic material particles 10.

PRODUCTION EXAMPLES 11 OF MAGNETIC MATERIAL PARTICLES FOR COMPARISON

Magnetic material particles 11 for comparison were produced in the same manner as in Production Example 1 of Magnetic Material Particles except that soda silicate was not added in the production process of the core magnetic material particles. Table 1 shows the physical properties of the magnetic material particles 11.

In Table 1:

"A" represents "a ratio (mass %) of the mass of adsorbed moisture to the total mass of magnetic material particles at 28° C. and at a relative vapor pressure of 50%";

"ΔA" represents "a ratio (mass %) of the maximum difference at a relative vapor pressure of 5% to 90% between the mass of adsorbed moisture in an adsorbing process at 28° C. and the mass of adsorbed moisture in a desorbing process at 28° C. to the total mass of magnetic material particles";

"B" represents "a ratio (mass %) of the mass of a titanium compound in magnetic material particles in $TiO_2$ equivalent to the total mass of the magnetic material particles"; and $Fe^{2+}$ retention" represents "a ratio of an $Fe^{2+}$ content in magnetic material particles after a heat treatment to an $Fe^{2+}$ content in the magnetic material particles before the heat treatment".

TABLE 1

Production Examples of Magnetic Materials

| Magnetic material particles No | A (mass %) | ΔA (mass %) | Isoelectric point (–) | B (mass %) | A/B (–) | Average particle size(μm) | Shape | $Fe^{2+}$ content before heat treatment (mass %) | $Fe^{2+}$ retention (%) |
|---|---|---|---|---|---|---|---|---|---|
| 1 | 0.31 | 0.02 | 7.2 | 0.90 | 0.34 | 0.15 | Spherical | 22 | 67 |
| 2 | 0.68 | 0.07 | 5.0 | 5.20 | 0.13 | 0.15 | Spherical | 23 | 88 |
| 3 | 0.79 | 0.09 | 4.9 | 8.90 | 0.09 | 0.12 | Spherical | 20 | 80 |
| 4 | 0.26 | 0.04 | 6.7 | 0.50 | 0.52 | 0.27 | Octahedral | 24 | 61 |
| 5 | 0.45 | 0.08 | 6.1 | 10.20 | 0.04 | 0.07 | Spherical | 18 | 58 |
| 6 | 0.77 | 0.07 | 4.4 | 9.50 | 0.08 | 0.23 | Spherical | 23 | 72 |
| 7 | 0.36 | 0.06 | 7.6 | 0.05 | 7.20 | 0.10 | Spherical | 20 | 53 |
| 8 | 0.85 | 0.12 | 4.2 | 10.50 | 0.08 | 0.15 | Spherical | 19 | 65 |
| 9 | 0.30 | 0.20 | 8.3 | 0.08 | 3.80 | 0.09 | Spherical | 16 | 47 |
| 10 | 0.72 | 0.11 | 3.9 | 9.60 | 0.08 | 0.27 | Octahedral | 24 | 73 |
| 11 | 0.22 | 0.03 | 7.4 | — | — | 0.30 | Spherical | 21 | 42 |

BINDER RESIN PRODUCTION EXAMPLE 1

40 parts by mass of bisphenol A-propylene oxide (PO) adduct (1:2), 30 parts by mass of bisphenol A-ethylene oxide adduct (EO) (1:2), 25 parts by mass of terephthalic acid, 4 parts by mass of fumaric acid, 5 parts by mass of trimellitic anhydride, and 0.5 part by mass of dibutyltin oxide were fed into a reaction vessel, and the whole was subjected to polycondensation at 220° C. to produce polyester as a binder resin 1. The binder resin 1 had an acid value of 22 mgKOH/g, a hydroxyl value of 32 mgKOH/g, a Tg of 59° C., a weight average molecular weight [Mw] of 220,000, and a THF insoluble matter content of 14 mass %.

The THF insoluble matter content in the binder resin was determined from the amount of residue of Soxhlet extraction in the case that the binder resin was subjected to the Soxhlet extraction with tetrahydrofuran (THF) as a solvent. More specifically, the weighed binder resin was placed into extraction thimble (such as No. 86R size 28×10 mm, manufactured by ADVANTEC), and was extracted with 200 ml of THF as a solvent for 16 hours at such a reflux rate that the extraction cycle of THF would be once per about 4 to 5 minutes. After the completion of the extraction, the extraction thimble was taken out and weighed to determine the THF insoluble matter content in the binder resin from the following equation.

$$\text{THF insoluble matter content (mass \%)} = W2/W1 \times 100$$

In the above equation, W1 represents the weight (g) of the binder resin placed into the extraction thimble, and W2 represents the weight (g) of the binder resin in the extraction thimble after the extraction.

BINDER RESIN PRODUCTION EXAMPLE 2

40 parts by mass of bisphenol A-propylene oxide (PO) adduct (1:2), 70 parts by mass of bisphenol A-ethylene oxide (EO) adduct (1:2), 50 parts by mass of terephthalic acid, 1 part by mass of trimellitic anhydride, and 0.5 part by mass of dibutyltin oxide were subjected to polycondensation in the same manner as in Binder Resin Production Example 1 to produce polyester as a binder resin 2. The binder resin 2 had an acid value of 3.6 mgKOH/g, a hydroxyl value of 22 mgKOH/g, a Tg of 65° C., an Mw of 50,000, and a THF insoluble matter content of 4 mass %.

BINDER RESIN PRODUCTION EXAMPLE 3

100 parts by mass of bisphenol A-propylene oxide (PO) adduct (1:2), 32 parts by mass of isophthalic acid, 12 parts by mass of terephthalic acid, 1 part by mass of trimellitic anhydride, and 0.5 part by mass of dibutyltin oxide were subjected to polycondensation in the same manner as in Binder Resin Production Example 1 to produce polyester as a binder resin 3. The binder resin 3 had an acid value of 2.0 mgKOH/g, a hydroxyl value of 54 mgKOH/g, an Mw of 60,000, a Tg of 52° C., and a THF insoluble matter content of 0 mass %.

BINDER RESIN PRODUCTION EXAMPLE 4

40 parts by mass of bisphenol A-ethlyene oxide (EO) adduct (1:2), 12 parts by mass of terephthalic acid, 7 parts by mass of trimellitic anhydride, 5 parts by mass of dodecenylsuccinic acid, and 0.5 part by mass of dibutyltin oxide were subjected to polycondensation in the same manner as in Binder Resin Production Example 1 to produce polyester as a binder resin 4. The binder resin 4 had an acid value of 42 mgKOH/g, a hydroxyl value of 4.8 mgKOH/g, an Mw of 280,000, a Tg of 55° C., and a THF insoluble matter content of 5 mass %.

BINDER RESIN PRODUCTION EXAMPLE 5

300 parts by mass of xylene were placed into a four-necked flask, and were refluxed while the temperature was increased. Then, a mixed solution of 80 parts by mass of styrene, 20 parts by mass of n-butyl acrylate, and 2 parts by mass of di-tert-butyl peroxide was dropped over 5 hours to produce a solution of a low-molecular-weight polymer having an Mw of 15,000. The solution obtained was referred to as "L-1".

Meanwhile, 180 parts by mass of deaerated water and 20 parts by mass of a 2-mass % aqueous solution of polyvinyl alcohol were charged into a four-necked flask. Then, a mixed solution of 75 parts by mass of styrene, 25 parts by mass of n-butyl acrylate, 0.005 part by mass of divinylbenzene, and 0.1 part by mass of 2,2-bis(4,4-di-tert-butylperoxycyclohexyl)propane (having a half life of 10-hour at 92° C.) was added to the flask, and the whole was stirred to prepare a suspension. After the air in the flask had been sufficiently replaced with nitrogen, the temperature of the flask was increased up to 85° C. for polymerization of the mixture in the flask. This state was maintained for 24 hours. After that, 0.1 part by mass of benzoyl peroxide (having a half life of 10-hour at 72° C.) was added to the flask, and the whole was maintained for an additional 12 hours to complete the polymerization of a high-molecular-weight polymer. The solution obtained is referred to as "H-1".

25 parts by mass of the high-molecular-weight polymer solution (H-1) were placed into 300 parts by mass of the low-molecular-weight polymer solution (L-1), and the whole was sufficiently mixed under reflux. After that, an organic solvent was distilled off to produce a styrene-based binder resin 5. The binder resin 5 had an acid value of 0 mgKOH/g, a hydroxyl value of 0 mgKOH/g, a Tg of 57° C., an Mw of 300,000, and a THF insoluble matter content of 0 mass %.

PRODUCTION EXAMPLE 1 OF MAGNETIC TONER

| | |
|---|---|
| Binder resin 1: | 100 parts by mass |
| Wax: (low-molecular-weight polyethylene, DSC highest peak temperature: 102° C., Mn: 850) | 3 parts by mass |
| Magnetic material particles 1: | 95 parts by mass |
| Azo-based iron compound (1) (a counter ion is $NH^{4+}$): | 2 parts by mass |

The above raw materials were premixed by means of HENSCHEL MIXER (manufactured by Mitsui Mining Co., Ltd.) as a mixer. The resultant premixture was kneaded by means of a biaxial kneading extruder set at 200 rpm while a set temperature was adjusted in such a manner that a temperature near the outlet of a kneaded product would be 150 to 160° C. The resultant kneaded product was cooled and coarsely pulverized by means of a cutter mill. After that, the resultant coarsely pulverized product was finely pulverized by means of TURBO MILL (manufactured by Turbo Kogyo Co., Ltd.). The finely pulverized product was classified by means of a multi-division classifier utilizing Coanda effect to produce negatively chargeable magnetic toner particles 1 having a weight average particle size (D4) of 6.3 μm.

1.0 part by mass of hydrophobic silica fine particles was externally added to and mixed with 100 parts by mass of the magnetic toner particles 1 by means of HENSCHEL MIXER (manufactured by Mitsui Mining Co., Ltd.) to produce a magnetic toner 1. Table 2 shows the physical properties of the magnetic toner 1.

PRODUCTION EXAMPLES 2 TO 7 OF MAGNETIC TONERS 2 TO 7

Each of magnetic toners 2 to 7 was produced in the same manner as in Production Example 1 of Magnetic Toner except that: the binder resin and the magnetic material particles were changed as shown in Table 2; and the weight average particle size of toner particles was adjusted through pulverization and classification processes as shown in Table 2. Table 2 shows the physical properties of the magnetic toners 2 to 7.

PRODUCTION EXAMPLES 8 TO 11 OF COMPARATIVE MAGNETIC TONERS

Each of comparative magnetic toners 8 to 11 was produced in the same manner as in Production Example 1 of Magnetic Toner except that: the binder resin and the magnetic material particles were changed as shown in Table 2; and the weight average particle size of toner particles was adjusted through pulverization and classification processes as shown in Table 2.

TABLE 2

Production Examples of Magnetic Toners

| | Binder resin | Magnetic material particles | Weight average particle size (μm) |
|---|---|---|---|
| Magnetic Toner 1 | Binder resin 1 | Magnetic material particles 1 | 6.3 |
| Magnetic Toner 2 | Binder resin 1 | Magnetic material particles 2 | 6.3 |
| Magnetic Toner 3 | Binder resin 1 | Magnetic material particles 3 | 7.2 |
| Magnetic Toner 4 | Binder resin 3 | Magnetic material particles 4 | 5.9 |
| Magnetic Toner 5 | Binder resin 2 | Magnetic material particles 5 | 8.5 |
| Magnetic Toner 6 | Binder resin 1 | Magnetic material particles 6 | 5.6 |
| Magnetic Toner 7 | Binder resin 3 | Magnetic material particles 7 | 5.0 |
| Cmparative magnetic toner 8 | Binder resin 4 | Magnetic material particles 8 | 5.4 |
| Cmparative magnetic toner 9 | Binder resin 3 | Magnetic material particles 9 | 8.8 |
| Cmparative magnetic toner 10 | Binder resin 5 | Magnetic material particles 10 | 4.3 |
| Cmparative magnetic toner 11 | Binder resin 3 | Magnetic material particles 11 | 4.2 |

EXAMPLE 1

(Evaluation 1)

A commercially available LBP printer (Laser Jet 4300, manufactured by HP) was reconstructed so as to be capable of printing 55 sheets of A4 size paper/min (a process speed of 325 mm/sec), and a reconstructed process cartridge with the volume of a toner filling portion increased by a factor of 2 was mounted on the reconstructed printer.

By using the above printer as an image output test machine, a print test was performed in a high-temperature-and-high-humidity environment of 35° C. and 85% RH in the mode described below. In the mode, 2 sheets per one job, a transverse line pattern having a printing ratio of 1% was printed on each of the sheets; and the machine was suspended every other job.

An image density was measured after duration of 20,000 sheets, and the image density was compared with an image density at an initial stage of the duration. A reflection density at an initial stage was 1.50, and a reflection density after the duration was 1.48. This means that density stability was good. Table 3 shows the results.

An image density was determined from measuring the reflection density of a 5-mm square solid black image by means of MACBETH DENSITOMETER (Macbeth) as a reflection densitometer with an SPI filter. The evaluation criteria of an image density are shown below.

A: A reduction in image density before and after duration is less than 2%.

B: A reduction in image density before and after duration is 2% or more and less than 4%.

C: A reduction in image density before and after duration is 4% or more and less than 8%.

D: A reduction in image density before and after duration is 8% or more.

After the evaluation of an image density, 10 sheets of a halftone pattern having a printing ratio of 25% were output to observe the degree of occurrence of fading. As a result, no fading occurred even when a halftone image having a high printing ratio was output, so an image free from unevenness was obtained. Table 3 shows the results. The evaluation criteria of fading are shown below.

A: No occurrence.

B: A portion with a slightly reduced density exists.

C: A density reduces apparently in a belt fashion.

After the completion of the above evaluation, the state of occurrence of a flaw and filming on the surface of a photosensitive member was visually observed, and their effects on an output image were confirmed. As a result, the occurrence of a flaw or filming on a photosensitive member was not observed. Table 3 shows the results. The evaluation criteria are shown below.

A: Very good.

B: Good. The occurrence of a flaw or filming on a photosensitive member is slightly observed, but has nearly no effect on an output image.

C: Practicable. The occurrence of a flaw or filming on a photosensitive member is observed, but has a small effect on an output image.

D: Not practicable. An image defect occurs.

(Evaluation 2)

The image output test machine used in Evaluation 1 was left standing overnight in a low-temperature-and-low-humidity environment of 15° C. and 10% RH. After that, aprinting test of 1,000 sheets was additionally performed in the mode described below. In the mode; 1 sheet per one job, a transverse line pattern having a printing ratio of 1% was printed on each of the sheets; and the machine was suspended every other job.

Under condition for accelerating fogging, that is, an amplitude of alternating component of a developing bias was set to 1.8 kV with a default voltage of 1.6 kV, 2 sheets of solid white image were printed out successively, and fogging of the image on the second sheet was measured according to the following method.

The reflection densities of a transfer material before and after image formation were measured by means of a reflection densitometer (REFLECTOMETER MODEL TC-6DS manufactured by Tokyo Denshoku). The worst value of the reflection density of the transfer material after the image formation was denoted by Ds, and the average value of reflection densities of the transfer material before the image formation was denoted by Dr to determine the differential value between Ds and Dr "Ds−Dr". The determined differential value "Ds−Dr" was regarded as a fogging amount. The lower the value, the smaller the fogging amount. The fogging amount was 0.2 in this test. This is a good result. Table 3 shows the results.

The evaluation criteria of fogging are shown below.

A: Less than 0.5.

B: 0.5 or more and less than 1.0.

C: 1.0 or more and less than 2.5.

D: 2.5 or more.

Scattering of toner to the peripheral portion of a letter printed on cardboard (105 g/m$^2$) was visually evaluated. Nearly no scattering was observed, and a sharp letter image was obtained in this test.

The evaluation criteria of scattering are shown below.

A: Nearly no scattering is observed.

B: Scattering is observed, but is not annoying.

C: Scattering is remarkable.

(Evaluation 3)

The color tone of a solid black image was measured, whereby blackness of magnetic toner was quantitatively evaluated.

Subsequent to Evaluation 2, the developing contrast was adjusted in such a manner that the transmission density of a solid black image would be 1.7. After that, one sheet (A4 size paper) of a solid black image was printed out, and the image of color tone was measured. The transmission density was measured by means of a transmission densitometer RD914 manufactured by Macbeth.

The color tone was quantitatively measured on the basis of the definition of a color system specified in Commission Internationale de l'Eclairage (CIE) on 1976. A spectral chromatometer Type938 (manufactured by X-Rite) was used as a measuring device (Light source for observation; C light source: View angle; 2°). As a result, a value a* was +0.31, a value b* was −0.37, and a value L* was +20.5.

EXAMPLES 2 TO 7

Each of the magnetic toners 2 to 7 was evaluated in the same manner as in Example 1. Table 3 shows the results.

COMPARATIVE EXAMPLES 1 TO 4

Each of the comparative magnetic toners 8 to 11 was evaluated in the same manner as in Example 1. Table 3 shows the results.

TABLE 3

| | Evaluation results | | | | | | | | |
|---|---|---|---|---|---|---|---|---|---|
| | Image density | Flaw on photosensitive member | Filming | Fading | Fogging | Scattering | Value A* | Value b* | Value L* |
| Example 1 | A | B | A | A | A | A | +0.31 | −0.37 | +20.5 |
| Example 2 | A | A | A | A | A | A | +0.20 | −0.55 | +19.2 |
| Example 3 | A | A | A | A | A | A | +0.25 | −0.40 | +18.9 |
| Example 4 | B | A | A | B | B | B | +0.34 | −0.20 | +19.7 |
| Example 5 | B | A | B | B | B | A | +0.45 | −0.05 | +22.1 |
| Example 6 | B | B | A | A | A | A | +0.22 | −0.38 | +19.3 |
| Example 7 | B | B | B | A | B | A | +0.42 | −0.15 | +21.5 |
| Comparative Example 1 | D | B | C | C | A | A | +0.35 | −0.18 | +21.4 |
| Comparative Example 2 | D | C | C | C | B | A | +1.15 | +0.32 | +23.2 |
| Comparative Example 3 | B | C | A | B | D | C | +0.28 | −0.45 | +19.8 |
| Comparative Example 4 | B | D | C | C | C | C | +0.95 | +0.16 | +22.5 |

This application claims priority from Japanese Patent Application No. 2004-296446 filed Oct. 8, 2004, which is hereby incorporated by reference herein.

What is claimed is:

1. A magnetic toner comprising magnetic toner particles containing at least a binder resin and magnetic material particles each containing a titanium compound, wherein:

I) a ratio A [mass %] of a mass of moisture adsorbed to the magnetic material particles to a total mass of the magnetic material particles at a temperature of 28° C. and at a relative vapor pressure of 50% is 0.25 to 0.80 [mass %];

II) a difference at an arbitrary relative vapor pressure between a mass of moisture adsorbed to the magnetic material particles in an adsorbing process for increasing a relative vapor pressure at a temperature of 28° C. and a mass of moisture adsorbed to the magnetic material particles in a desorbing process for reducing a relative vapor pressure at the same temperature is 0.10 mass % or less based on the total mass of the magnetic material particles; and III) a ratio B [mass %] of a mass of the titanium compound in $TiO_2$ equivalent to the total mass of the magnetic material particles is 0.1 to 10.0 [mass %].

2. The magnetic toner according to claim 1, wherein the magnetic material particles have an isoelectric point of pH 4.1 to 8.0.

3. The magnetic toner according to claim 1, wherein the ratio A [mass %] and the ratio B [mass %] satisfy the following equation (1).

$$0.50 \geqq A/B \geqq 0.05 \quad (1)$$

4. The magnetic toner according to claim 1, wherein the magnetic material particles have an average particle size of 0.08 μm to 0.25 μm.

5. The magnetic toner according to claim 1, wherein when the magnetic material particles are subjected to a heat treatment at 160° C. for 1 hour in air, a ratio of an $Fe^{2+}$ content in the magnetic material particles after the heat treatment to an $Fe^{2+}$ content in the magnetic material particles before the heat treatment is 60% or more.

6. The magnetic toner according to claim 1, wherein the binder resin has an acid value of 1 mgKOH/g to 50 mgKOH/g.

7. The magnetic toner according to claim 1, wherein the binder resin has at least a polyester unit.

* * * * *